US009683271B2

(12) United States Patent
Song et al.

(10) Patent No.: US 9,683,271 B2
(45) Date of Patent: Jun. 20, 2017

(54) IMPELLER AND METHOD OF MELT-POOL PROCESSING METHOD USING THE SAME

(71) Applicant: POSCO, Pohang-Si (KR)

(72) Inventors: Min Ho Song, Gwangyang-Si (KR); Wook Kim, Pohang-Si (KR); Soo Chang Kang, Gwangyang-Si (KR); Woong Hee Han, Gwangyang-Si (KR); Jung Ho Park, Gwangyang-Si (KR)

(73) Assignee: POSCO, Pohang-si (KR)

( * ) Notice: Subject to any disclaimer, the term of this patent is extended or adjusted under 35 U.S.C. 154(b) by 52 days.

(21) Appl. No.: 14/434,503

(22) PCT Filed: Sep. 9, 2013

(86) PCT No.: PCT/KR2013/008106
§ 371 (c)(1),
(2) Date: Apr. 9, 2015

(87) PCT Pub. No.: WO2014/058157
PCT Pub. Date: Apr. 17, 2014

(65) Prior Publication Data

US 2015/0267270 A1 Sep. 24, 2015

(30) Foreign Application Priority Data

Oct. 10, 2012 (KR) ..... 10-2012-0112201
Oct. 12, 2012 (KR) ..... 10-2012-0113600
Oct. 12, 2012 (KR) ..... 10-2012-0113601

(51) Int. Cl.
*C21C 1/02* (2006.01)
*C21C 7/064* (2006.01)
(Continued)

(52) U.S. Cl.
CPC ..... *C21C 1/02* (2013.01); *C21C 1/025* (2013.01); *C21C 1/06* (2013.01); *C21C 7/064* (2013.01); *C21C 7/0645* (2013.01); *F27D 27/00* (2013.01)

(58) Field of Classification Search
CPC ..... C21C 1/02; C21C 1/025
See application file for complete search history.

(56) References Cited

U.S. PATENT DOCUMENTS 5,846,481 A 12/1998 Tilak

FOREIGN PATENT DOCUMENTS

CN 1254763 5/2000
JP 5158110 10/1974
(Continued)

OTHER PUBLICATIONS

European Search Report—European Application No. 13845014.3, issued on Jun. 1, 2016, citing U.S. Pat. No. 5,846,481, JP 2005 068506 and JP S51 58110.
(Continued)

*Primary Examiner* — Rebecca Lee
(74) *Attorney, Agent, or Firm* — Cantor Colburn LLP

(57) ABSTRACT

An impeller for stirring a melt pool includes: an impeller body extending in the length direction; a blowing nozzle which is provided in such a way as to pass through one part at the bottom end of the impeller body; and a blade provided on the upper part of the impeller body. As a result, when the impeller is used, a stirring flow produced due to the blade and a stirring flow due to substances blown into the melt-pool via the blowing nozzle correspond to each other, and the two flows are combined such that the overall stirring force is improved. Consequently, it is possible to improve the efficiency of stirring by the impeller as compared with hitherto, and, as a result, refining efficiency in the refining
(Continued)

step is improved as the rate of reaction between the melt-pool and additives is increased.

22 Claims, 7 Drawing Sheets

(51) Int. Cl.
*F27D 27/00* (2010.01)
*C21C 1/06* (2006.01)

(56) References Cited

FOREIGN PATENT DOCUMENTS

| | | | | |
|---|---|---|---|---|
| JP | 5277910 | | 12/1975 | |
| JP | 61272312 | | 12/1986 | |
| JP | 62088747 | | 6/1987 | |
| JP | 01222014 | | 9/1989 | |
| JP | 07278644 | | 10/1995 | |
| JP | 11209829 | | 8/1999 | |
| JP | 2003119509 | | 4/2003 | |
| JP | 2003119509 | A * | 4/2003 | ..... C12C 1/02 |
| JP | 2005068506 | | 3/2005 | |
| JP | 2006176874 | | 7/2006 | |
| JP | 2006176874 | A * | 7/2006 | |
| KR | 1019910009494 | | 11/1991 | |
| KR | 20100071660 | * | 6/2010 | |
| KR | 1020100071660 | | 6/2010 | |
| KR | 20100098977 | * | 9/2010 | |
| KR | 1020100098977 | | 9/2010 | |
| KR | 101036317 | | 5/2011 | |
| KR | 1020110065965 | | 6/2011 | |
| KR | 1020130030350 | | 3/2013 | |

OTHER PUBLICATIONS

International Search Report—PCT/KR2013/008106 dated Dec. 3, 2013.
Written Opinion—PCT/KR2013/008106 dated Dec. 3, 2013.

* cited by examiner

IMPELLER AND METHOD OF MELT-POOL PROCESSING METHOD USING THE SAME

TECHNICAL FIELD

The present invention relates to an impeller and a method of processing a melt-pool using the same, and more particularly, to an impeller capable of enhancing the refining efficiency, and a method of processing a melt-pool using the same.

BACKGROUND ART

Phosphorous (P) in ferro manganese used as an alloy of iron in steelmaking is a factor deteriorating the quality of products steel, for example, a cause of high temperature brittleness. Accordingly, dephosphorization removing phosphorous (P) from molten ferro manganese, i.e., ferro manganese melt-pool is generally conducted.

In a typical dephosphorization process for producing ferro manganese, melt-pool is poured into a ladle and an impeller is submerged into the melt-pool to stir the melt-pool. Herein, a general impeller 20 is provided with wings, i.e., blades at a lower side of a stirring shaft as disclosed in Korean Patent Publication No. 2011-0065965. Again describing the general impeller with reference to FIG. 2, the impeller includes an impeller body 21 extending in a longitudinal direction thereof, a plurality of blades 22 connected to a circumferential surface of a lower portion of the impeller body 21, an blowing nozzle 23 configured to pass through each of the plurality of blades 22, a supply tube 24 configured to pass through inner centers of the impeller body 21 and the blades 22 and to supply a dephosphorization agent and gas, and a flange 25 connected to an upper end of the impeller body 21. The flange 25 is connected to a driving unit (not shown) providing rotational power.

A stirring flow by an operation of the impeller 20 will be described below in brief. As shown in FIG. 2, a stirring flow (arrow of solid line) generated in an inner wall direction by the rotation of the blades 22 collides with an inner wall of the ladle 10, and then is divided and flows into up and down directions along the inner wall of the ladle 10. Then, a flow in which the dephosphorization agent and gas sprayed from the blowing nozzle 23 ascends along outer circumferential surfaces of the blades 22 and the impeller body 21 collides with a flow in which the dephosphorization agent and gas collide with the inner wall of the ladle 10 by the rotation of the blades 22, then ascend, and again descend. Also, the flow in which the dephosphorization agent and gas ascend along the outer circumferential surfaces of the blades 22 and the impeller body 21 and then again fall along the inner wall of the ladle 10 collides with the stirring flow which is generated by the rotation of the blades 22 and ascends along the inner wall of the ladle 10. A stirring force is cancelled by the collision of these flows, which becomes a factor to reduce the rate of reaction between the melt-pool and the dephosphorization agent and to thus reduce the dephosphorization rate.

Meanwhile, as a method of controlling a phosphorous component in the melt-pool, there is a method which removes phosphorous (P) in the melt-pool in the form of phosphorous oxide ($Ba_3(PO_4)_2$ or the like) through oxidation dephosphorization. The dephosphorization agent for controlling the phosphorous component in the melt-pool may include $BaCO_3$, BaO, $BaF_2$, $BaCl_2$, CaO, $CaF_2$, $Na_2CO_3$, and $Li_2CO_3$, and may be in the form of flux.

Among these, since the Ca-based materials have low dephosphorization efficiency and the Na- and Li-based materials have high vapor pressure, a rephosphorization phenomenon is generated. Since it is known that the higher the alkalinity, the higher the dephosphorization performance of the dephosphorization agent as dephosphorization flux, Ba-based compounds ($BaCO_3$, BaO, etc.) that have high alkalinity and do not have high vapor pressure have been mainly used and developed. However, when the Ba-based compounds are used as the dephosphorization agents, the high melting point thereof allows a phosphorous component to be obtained in the form of solid, so that there is a problem that the dephosphorization efficiency is reduced. Accordingly, in order to address such an issue, methods of adding $BaCl_2$, $BaF_2$, $NaF_2$ or the like have been developed. In the case of BaCl2, slag on the ferro manganese is scattered by vaporization of chlorine (Cl) group having strong volatility and flies away, and facility corrosion may be caused by volatilization of Cl group. Also, since $BaF_2$ is very expensive, $BaF_2$ is difficult to use in terms of establishing an economical production process. Further, $NaF_2$ is volatilized to fly away with the course of treatment process time, and thus the concentration thereof is lowered. Eventually, only a decrease of the melting point may be expected by the F effect, and in order to overcome this issue, it is necessary to increase the content of $NaF_2$.

When the slag has a very high melting point, in order to obtain the flux effect, there is a method of producing a Ba-based dephosphorization agent in liquid form for use thereof in addition to a method of adding elements other than Ba-based elements (Application No. 2011-0093754). When the dephosphorization agent is used in liquid form, a temperature drop due to the adding of a solid dephosphorization agent with a relatively low temperature may be suppressed, and skull generation due to the solidification phenomenon may be prevented to increase the dephosphorization effect, which leads to the improvement of recovery of ferro manganese after the dephosphorization. Furthermore, there is an advantage that a mixing amount of raw materials ($BaCl_2$, $BaF_2$, NaF, etc.) considered as the flux may be reduced or any of the raw materials may be excluded in accordance with the liquefaction temperature of the dephosphorization agent.

However, in the aforementioned method of using the liquefied and melted dephosphorization agent, since a liquefaction method is a method of heating a dephosphorization agent to a temperature higher than a melting point thereof and liquefying the dephosphorization agent, although the dephosphorization agent is liquefied at a temperature higher than the melting point thereof to be used when the melting point of the dephosphorization agent used is very high, a difference between the melting point and the liquefied temperature is decreased, so that an applicable range is narrow. Also, generally, when a difference between the melting point of dephosphorization agent and the liquefied temperature is decreased due to a high melting point thereof, fluidity of the dephosphorization agent is very low, so that it is very difficult to control in adding a liquid dephosphorization agent.

Further, in order to maintain alkalinity of dephosphorization slag at a high level in a dephosphorization process using a Ba-based dephosphorization agent, a BaO content functions as a major criterion. However, in the case of BaO, dephosphorization slag can be maintained in a state of high alkalinity, but it is difficult to use BaO by itself as a dephosphorization agent in a real process. BaO can be produced through a calcination reaction of $BaCO_3$, but the produced BaO is easily hydrated due to very high reactivity with moisture. In addition, when BaO is converted into a hydrate such as $Ba(OH)_2$ or the like, the $Ba(OH)_2$ reacts with $CO_2$ in the air to be converted into $BaCO_3$, so that there are troubles such as storage. Therefore, typically, when a Ba-based dephosphorization agent is used, $BaCO_3$ is used as a main raw material. When $BaCO_3$ is used, a $CO_2$ gas is generated while a calcination reaction is performed in a high temperature ferro manganese melt-pool, so that the generated $CO_2$ gas functions to massively supply oxygen, and BaO generated through the calcination reaction is contained in slag to maintain alkalinity of the slag at a high level. However, the $CO_2$ gas generated through the calcination reaction of $BaCO_3$ oxidizes Mn in the ferro manganese melt-pool, and thus the content of Mn oxide in the slag is increased to lower the alkalinity of the slag. Also, as a dephosphorization refining process continues, since the melt-pool is exposed to the air by the introduction of the dephosphorization agent and the continuation of process time, a temperature thereof is dropped, and an oxidizing of Mn is promoted, so that the dephosphorization efficiency of the dephosphorization agent is lowered.

When a solid dephosphorization agent, for example, a $BaCO_3$—NaF-based dephosphorization agent is used at the beginning, an initial melting point is high and $BaCO_3$ is calcinated through a high temperature refining reaction to increase the amount of BaO. Although a eutectic composition of BaO—$BaCO_3$ is made, it is difficult to achieve liquefaction due to component imbalance. Also, during a refining process, since an oxidized MnO component is contained to cause component imbalance, solidification or skull takes places and as a result, it is more difficult to achieve liquefaction.

DISCLOSURE OF THE INVENTION

Technical Problem

The present invention provides an impeller capable of reducing the refining efficiency, and a method of processing a melt-pool using the same.

The present invention also provides a flux capable of enhancing dephosphorization performance at an initial stage of dephosphorization, and a method of producing the same.

The present invention also provides a flux capable of reducing the oxidation rate of manganese in a dephosphorization process, and a method of producing the same.

The present invention provides a dephosphorization flux capable of improving the reaction efficiency by lowering the melting point thereof, and a method of producing the same.

The present invention also provides a flux capable of improving the dephosphorization efficiency of ferro manganese, and a method of producing the same.

Technical Solution

An impeller for stirring melt-pool in accordance with the present invention includes: an impeller body extending in a longitudinal direction; a blowing nozzle configured to pass through a portion of a lower portion of the impeller body; and a blade installed at an upper portion of the impeller body.

The impeller body is submerged in a container containing the melt-pool, and the impeller body is submerged at least from a bath surface of the melt-pool to a lower region of the melt-pool.

The above impeller further includes a supply tube which is configured to longitudinally pass through an inside of the impeller body and has a lower end communicating with the blowing nozzle.

When it is assumed that the melt-pool contained in the container has a height of H, the blade is positioned at a region above a (½)H position from a bottom surface of the container, and the blowing nozzle is positioned at a region under the (½)H position from the bottom surface of the container.

The blade is installed adjacent to the bath surface of the melt-pool and the blowing nozzle is provided adjacent to the bottom surface of the container.

A method of processing melt-pool in accordance with the present invention, includes: preparing melt-pool; preparing a dephosphorization agent controlling a phosphorous (P) component contained in the melt-pool; submerging an impeller into the melt-pool; supplying the dephosphorization flux into the impeller to blow the dephosphorization flux into the melt-pool; rotating the impeller to stir the melt-pool into which the dephosphorization flux is blown, wherein the stirring comprising stirring the melt-pool such that a stirring flow direction of the melt-pool generated by the blade of the impeller corresponds to a stirring flow direction of the melt-pool generated by the dephosphorization agent blown into the melt-pool.

The stirring flow generated by the blade is divided in up and down directions to flow, and an area of the stirring flow of the melt-pool in the down direction of the blade is wider than an area of the stirring flow of the melt-pool in the up direction of the blade.

The stirring flow direction under the blade corresponds to the stirring flow direction of the melt-pool generated by the dephosphorization flux blown into the melt-pool.

The preparing the dephosphorization flux includes: preparing a main raw material including $BaCO_3$; and heating the main raw material to obtain a $BaCO_3$—BaO binary dephosphorization flux in which solid BaO and liquid BaO coexists with each other.

The preparing the dephosphorization flux includes: preparing a main raw material including $BaCO_3$; mixing a carbon (C) component to the main raw material; and heating the main raw material mixed with the carbon (C) component to obtain a liquid $BaCO_3$—BaO binary dephosphorization flux.

The above method further includes mixing at least any one of carbon (C) and $NaF_2$ to the main raw material.

The $NaF_2$ is mixed in a proportion more than 3.1 wt % and less than or equal to 10 wt % with respect to a total weight of the dephosphorization flux.

The heating is conducted in the air or an inert gas atmosphere for 1.5 hours to 5 hours.

The carbon (C) component is mixed in an amount 0.6 times the number of moles of BaO.

The heating is conducted at a temperature of 1,050° C. or higher.

The above method further includes mixing $NaF_2$ to the main raw material.

The $NaF_2$ is mixed in a proportion more than 3.1 wt % with respect to a total weight of the dephosphorization flux.

In the mixing the carbon (C) component, the carbon (C) component is mixed in an amount exceeding 0.018 g per 1 g of $BaCO_3$.

The heating the main raw material containing the carbon (C) component is conducted in the air or an inert gas atmosphere for 1 hours to 3 hours.

The amount of the carbon (C) component added in the heating in the air is more than the amount of carbon (C) added in the heating in the inert gas atmosphere.

The heating is conducted at a temperature of 1,050° C. or higher.

In the heating the main raw material mixed with the carbon (C) component, the following reaction takes places:

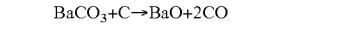

$$BaCO_3+C \rightarrow BaO+2CO$$

The above method further includes, after the obtaining the dephosphorization flux, solidifying the dephosphorization flux; and pulverizing the solidified dephosphorization flux.

The solidified dephosphorization flux is pulverized in a size exceeding 0 mm and less than or equal to 1 mm.

Advantageous Effects

According to embodiments of the present invention, blades and an blowing nozzle are configured to be individually separated, and installed such that the blades are positioned corresponding to an upper region of melt-pool and the blowing nozzle is positioned corresponding to a lower region of the melt-pool. Accordingly, the stirring flow generated by the blades corresponds to the stirring flow of a material blown into the melt-pool through the blowing nozzle, and the two flows are added to increase the overall stirring flow. Consequently, it is possible to improve the efficiency of stirring by the impeller as compared with hitherto, and, as a result, refining efficiency in the refining step is improved as the rate of reaction between the melt-pool and additives is increased.

A dephosphorization agent and method of producing the same in accordance with an exemplary embodiment of the present invention can enhance the initial dephosphorization performance in the initial dephosphorization of ferro manganese melt-pool. That is, by using a $BaCO_3$—BaO binary dephosphorization flux in which solid BaO and liquid BaO coexists with each other in dephosphorization, the partial pressure of $CO_2$ can be lowered to thus maximize the dephosphorization performance. Also, since the content of BaO in the dephosphorization flux is high, high alkalinity can be maintained from the initial process of dephosphorization to thus suppress oxidation of Mn.

A flux and method of producing the same in accordance with another exemplary embodiment of the present invention can decrease the melting point of a dephosphorization flux of ferro manganese to enhance the dephosphorization efficiency. By mixing carbon (C) to the dephosphorization flux having $BaCO_3$ as a main component to cause a calcination reaction, the melting point of the dephosphorization flux can be decreased through the composition of the eutectic point of the $BaCO_3$—BaO binary system. Accordingly, the calcination reaction by addition of carbon (C) at a relatively low temperature can be promoted and the calcination reaction by addition of carbon (C) at a relatively high temperature can be promoted without addition of a separate flux. Further, a desired composition of melt-pool can be produced by enhancing the dephosphorization efficiency.

MODE FOR CARRYING OUT THE INVENTION

Hereinafter, specific embodiments will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

Figure 1:
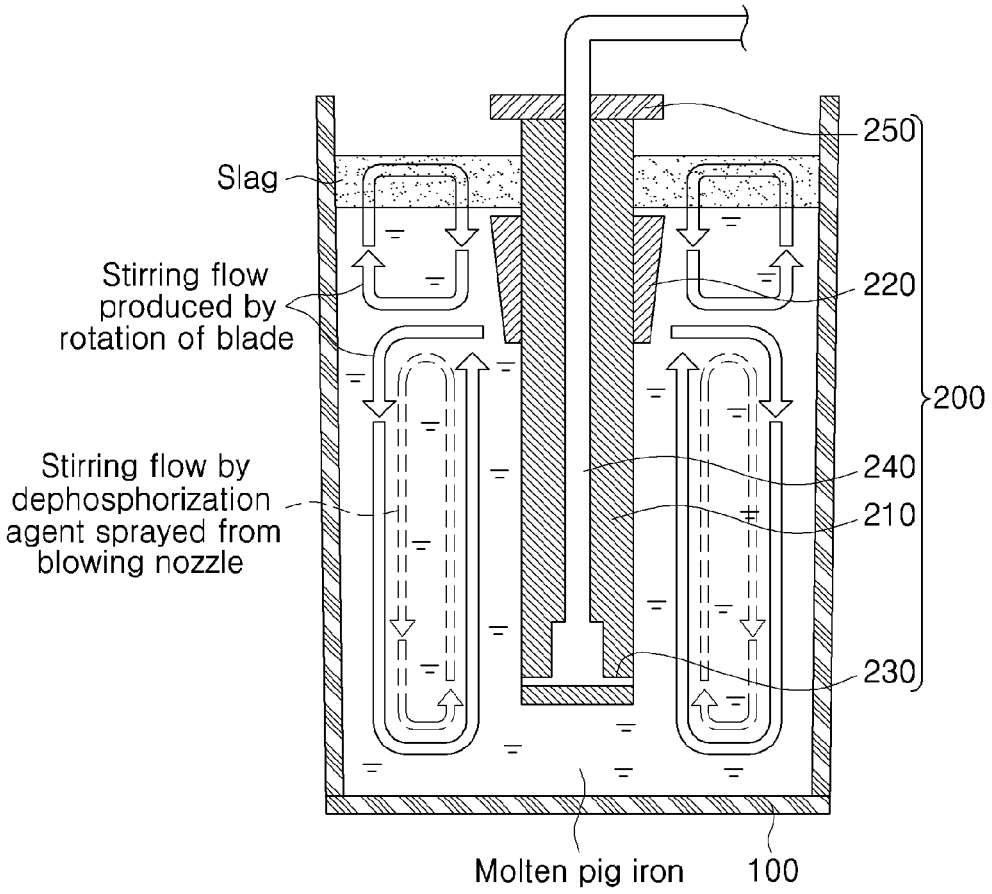
FIG. 1 is a cross-sectional view illustrating an impeller in accordance with an exemplary embodiment installed in a ladle containing a melt-pool or slag.
Figure 2:
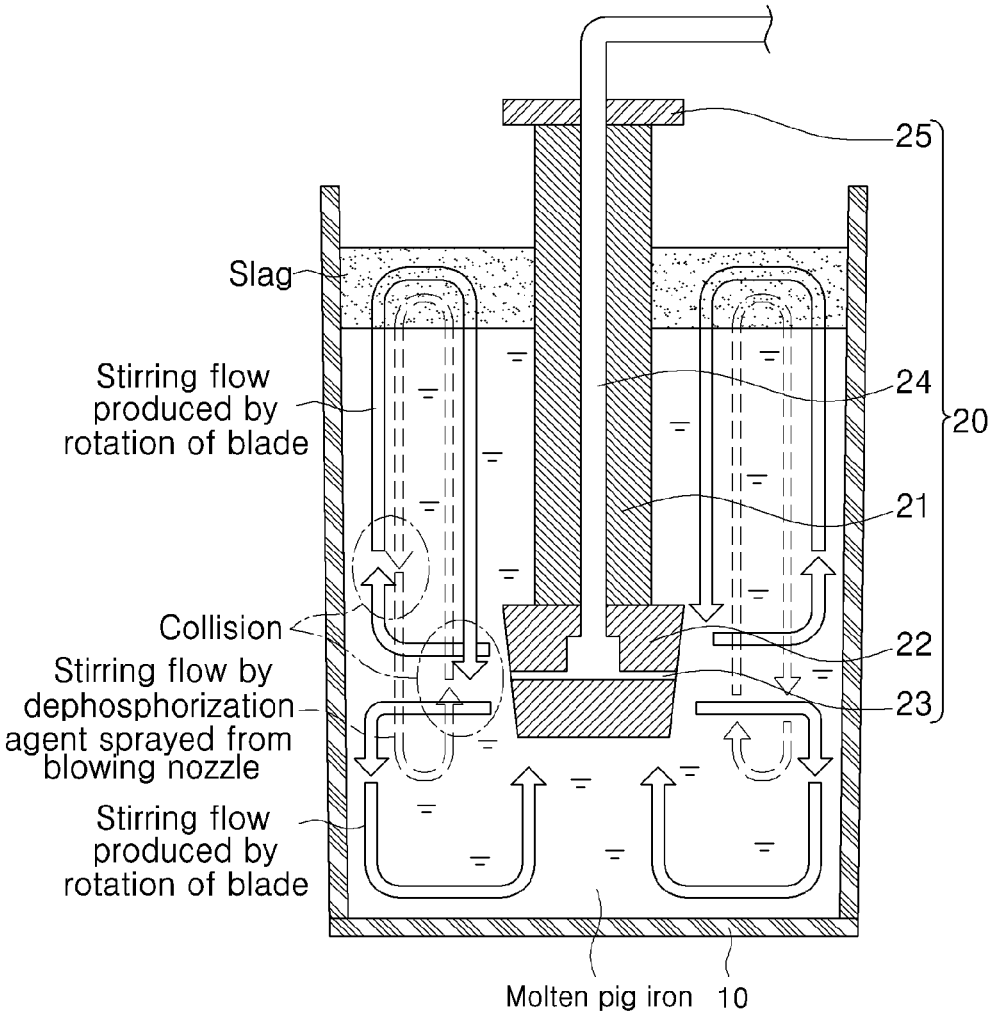
FIG. 2 Prior Art
FIG. 2 is a cross-sectional view illustrating a typical impeller installed in a ladle containing a melt-pool or slag.

FIG. 1 is a cross-sectional view illustrating an impeller in accordance with an exemplary embodiment installed in a ladle containing a melt-pool or slag. FIG. 2 is a cross-sectional view illustrating a typical impeller installed in a ladle containing a melt-pool or slag.

An impeller 200 is a stirrer that stirs melt-pool, more desirably, the melt-pool and a material (hereinafter, referred to as an additive) additionally added so as to refine the melt-pool. Referring to FIG. 1, the impeller 200 in accordance with an exemplary embodiment includes an impeller body 210, a blowing nozzle 230 provided to a lower portion of the impeller body 210 to blow an additive into a melt-pool, and a plurality of blades 220 installed at an upper portion of the impeller body 210. Also, the impeller 220 further includes a flange 250 connected to an upper end of the impeller body 250 above the plurality of blades 220, and a supply tube 240 configured to longitudinally pass through an inside of the impeller body 210 to supply additives to the blowing nozzle 230. The foregoing impeller 200 may be connected to a separate driving unit (not shown), for example, a motor installed outside the ladle 100 to provide rotational force, and the driving unit is preferably connected to the flange 250 among the constituent elements of the impeller 200.

Here, the melt-pool poured into the ladle may be molten ferro manganese, i.e., a ferro manganese melt-pool.

The additive added through the supply tube 240 and the blowing nozzle 230 is a dephosphorization agent for removing phosphorous (P) in the melt-pool, and is a $BaCO_3$—BaO binary system. Also, at the time that the additive is added into the melt-pool, the solid BaO and liquid BaO coexists with each other, or the additive is a liquid dephosphorization agent.

Of course, the additive is not limited thereto, but may be, as a dephosphorization agent, any one of $BaCO_3$, BaO, $BaF_2$, $BaCl_2$, CaO, $CaF_2$, $Na_2CO_3$, and $Li_2CO$ in the form of solid powder. When the dephosphorization agent is a solid powder, the dephosphorization agent may be added together with a gas. The added gas moves together with the dephosphorization agent, helps the dephosphorization agent move, and is blown into the melt-pool to stir the melt-pool. The above-described gas may be preferably an inert gas such as argon (Ar) or nitrogen ($N_2$).

The impeller body 210 is a rotation shaft or a main shaft of the impeller 200, extends in a longitudinal direction or a vertical direction, and extends so as to be submerged from a bath surface of the melt-pool to at least a lower region. More specifically, the impeller body 210 is installed such that an upper end thereof protrudes upward from slag, and a lower end thereof extends to the lower region of the melt-pool, and the lower end of the impeller body 210 is adjacent to a bottom surface of the ladle 100. The impeller 210 in accordance with an exemplary embodiment may have, but is not limited thereto, a circular pole shape in cross section, and alternatively may have a pole shape that has various cross-sections configured to easily rotate. The flange 250 is connected to the upper end of the impeller body 210 as described above and connected to a driving unit providing rotational force. Accordingly, the impeller body 210 is rotated by an operation of the driving unit, and the blades 220 are rotated together by the rotation of the impeller body 210.

The blowing nozzle 230 blows a predetermined material (i.e., a blown material) into the melt-pool, and the blown material may be an additive for refining, for example, a dephosphorization agent. The blowing nozzle 230 is provided to a lower portion of the impeller body 210, and it is effective that the blowing nozzle 230 be spaced as far apart as possible from the blades 220 installed at the upper side of the impeller body 210. In an exemplary embodiment, the blowing nozzle 230 is installed to be adjacent to a bottom surface of the ladle 100, and the blades 220 are installed to be adjacent to a bath surface of the melt-pool. In other words, the blowing nozzle 230 is individually separated from the blades 220 and is positioned in a lower region of the melt-pool contained in the ladle 100.

Also, the blowing nozzle 230 may be preferably formed in a direction intersecting with a direction (a vertical extension direction) in which the impeller body 210 extends. The blowing nozzle 230 in accordance with an exemplary embodiment extends in a horizontal direction of the impeller body, and diverges in a plurality of directions centered on the supply tube 240 configured to vertically pass through an inner center of the impeller body 21. The number of the diverged blowing nozzles 230 may be provided in number corresponding to the number of the blades 220 or provided in number equal to or more or less than the number of the blades 220. The blowing nozzle 230 in accordance with an exemplary embodiment may have, but limited thereto, a hole shape diverged in a horizontal direction centered on the supply tube 240 by processing an inside of the impeller body 210, for example, a structure formed by inserting a thin pipe having an inner space into the lower portion of the impeller body 210.

The blades 220 mechanically stir molten ferro manganese poured into the ladle 100, i.e., a dephosphorization agent added into the melt-pool and are installed at an upper portion of the impeller body 210. That is, the blades 220 are positioned so as to correspond to an upper region of the melt-pool contained in the ladle 100 and are individually separated from the blowing nozzle 230. For example, the blades 220 may be installed such that top surfaces thereof are adjacent to the bath surface of the melt-pool. The blade 220 is provided in plurality, connected to an upper outer circumferential surface of the impeller body 210. Also, the plurality of blades 220 are spaced an equal distance from each other on the outer circumferential surface of the impeller body 210. Further, the plurality of blades 220 are disposed in a cross shape with the impeller body 210 in-between in order to maximize stirring efficiency, and may be preferably disposed such that each pair of blades 210 are opposed to each other centered on the impeller body 210.

The supply tube 240 supplies the additive to the blowing nozzle 230 provided to the lower portion of the impeller 210 and is configured to longitudinally pass through the flange 250 and inner centers of and the impeller body 210. The supply tube 240 in accordance with an exemplary embodiment may have, but limited thereto, a hole shape formed by processing the flange 250 and an inside of the impeller body 210, for example, a structure formed by inserting a pipe having an inner space into the flange 250 and the inside of the impeller body 210. An upper end of the supply tube 240 may be connected to a tank storing an additive, for example, a dephosphorization agent, and a lower end thereof communicates with the blowing nozzle 230 provided to the lower portion of the impeller body 210.

As described above, in the present invention, the blowing nozzle 230 and the blades 220 are respectively positioned in a lower region of the melt-pool and an upper region of the melt-pool so as to be separated from each other. In addition, it is effective that the blowing nozzle 230 and the blades 220 be spaced as far apart as possible from each other. Installation positions of the blowing nozzle 230 and the blades 220 in accordance with an exemplary embodiment will be described in detail with examples. First, for the convenience of description, a height of the melt-pool contained in the ladle 100 is referred to as "H" (a distance from a bottom surface of the ladle to a top surface (bath surface) of the melt-pool), and the "H" is divided into four equal portions. In this regard, the blowing nozzle 230 is positioned in a region under a ½ position of height "H" of the melt-pool centered on the inner bottom surface of the ladle 100. In addition, the blades 220 are positioned in a region above the ½ position of height "H" of the melt-pool. More desirably, the blowing nozzle 230 is positioned in a region under a ¼ position of height "H" of the melt-pool centered on the surface of the ladle 100. In addition, the blades 220 are positioned in a region above the ¾ position of the height "H" of the melt-pool. Describing the installation positions based on the bath surface of the melt-pool contained in the ladle 100, the blades 220 are positioned in a region (a region adjacent to the bath surface) within a ¼ position centered on the bath surface. In addition, the blowing nozzle 230 is positioned in a region (a region adjacent to the bottom surface of the ladle) exceeding the ¾ position.

Thus, since the blowing nozzle 230 is positioned in a lower region of the melt-pool, and the blades 220 are positioned above the blowing nozzle 230, the stirring efficiency can be enhanced compared to a related art.

Hereinafter, a stirring flow of the melt-pool generated by the blades 220 of the impeller 200 in accordance with an exemplary embodiment and a stirring flow of the melt-pool by an additive blown from the blowing nozzle 230 will be described.

When the impeller body 210 is rotated by the driving unit, the blades 220 are rotated together with the impeller body 210. Also, as shown in FIG. 1, a stirring flow (arrow of solid line) generated by rotation of the blades 220 is generated in a inner wall direction of the ladle 100 from the blades 220 and collides with an inner wall of the ladle 220, and then is divided and flows in up and down directions along the inner wall of the ladle 100. At this time, since the blades 220 are positioned to be adjacent to the bath surface, an area of the stirring flow of the melt-pool in the lower direction of the blades 220 is greater than that in the upper direction of the blades 220. In more detail, after the stirring flow collides with the inner wall of the ladle 100, a portion of the stirring flow ascends along the inner wall of the ladle 100, then descends along outer circumferential surfaces of the impeller body 210 and the blades 220 via slag above the bath surface, and again descends. Also, the remaining portion of the stirring flow moves in a lower direction of the inner wall of the ladle 100, descends to an lower end of an inside of the ladle 100, and again ascends along an outer circumferential surface of the impeller body 210 positioned below the blades 220. Also, since the dephosphorization agent sprayed from the blowing nozzle 230 has low specific gravity, after the dephosphorization agent ascends at right angles along the outer circumferential surface of the impeller body 210, then flows toward the inner wall of the ladle 100 from the upper region of the melt-pool to descend by rotation the blades 220 positioned above the impeller body 210, and again ascends along the outer circumferential surface of the impeller body 210 (an arrow of dotted line). Also, the melt-pool is stirred to flow together by the stirring flow of the dephosphorization agent. Here, since the flow by the dephosphorization agent and the flow by the blades 220 described above are the corresponding or same directional flow, the flow by the dephosphorization agent and the flow by the blades 220 are combined to each other to improve stirring force.

Meanwhile, as described in Background Art, in the typical impeller 20, the blade 22 is installed at a lower portion of the impeller body 21, and the blowing nozzle 23 is provided in the blade 22. That is, in the typical impeller 20, the blade 22 and the blowing nozzle 23 are not separated from each other, In this regard, as shown in FIG. 2, a stirring flow (an arrow of solid line) of the melt-pool generated in an inner wall direction of the ladle 10 by the rotation of the blades 22 collides with the inner wall of the ladle 10, and then is divided and flows in up and down directions along the inner wall of the ladle 10. In more detail, after the stirring flow collides with the inner wall of the ladle 10, a portion of the stirring moves in an upward direction of the inner wall of the ladle 10, then descends along outer circumferential surfaces of the impeller body 21 and the blade 21 via slag above the bath surface, and again ascends. The remaining portion of the stirring flow moves in a downward direction of the inner wall of the ladle 10, descends to a lower end of an inside of the ladle 10, and again ascends. Also, the flow of the dephosphorization blown through the blowing nozzle 23 provided to the blade 22 and the flow of the melt-pool by the dephosphorization agent ascend at right angles along outer circumferential surfaces of the blade 22 and the impeller body 21, and then descend along the inner wall of the ladle 10 via slag above the bath surface (an arrow of dotted line). Meanwhile, a stirring flow, which is generated by an additive sprayed from the blowing nozzle 23 to ascend along outer circumferential surfaces of the blade 22 and the impeller body 21, collides with a flow (a portion indicated by a dotted circle of FIG. 2) colliding with the inner wall of the ladle 10, then ascending, and again descending by the rotation of the blade 22. Also, a stirring flow by the dephosphorization agent, which ascends along the outer circumferential surface of the impeller body 21 and then again descend along the inner wall of the ladle 10, collides with the stirring flow (a portion indicated by a dotted circle of FIG. 2) which is generated by the rotation of the blades 22 and ascends along the inner wall of the ladle 10. Also, in the typical impeller 20 in which the blowing nozzle 23 is provided in the blade 22 as shown in FIG. 2, the aforementioned collision occurs in a region above the blade 11 or at a position corresponding to the blade 22. When the stirring flow by the additive and the stirring flow by the rotation of the blade 22 collide with each other, the two flows are cancelled by an interaction therebetween, and resultantly, the overall stirring force is reduced. This causes a decrease in reaction rate between the melt-pool of the ladle 10 and the dephosphorization, and a decrease in dephosphorization rate.

Figure 3:
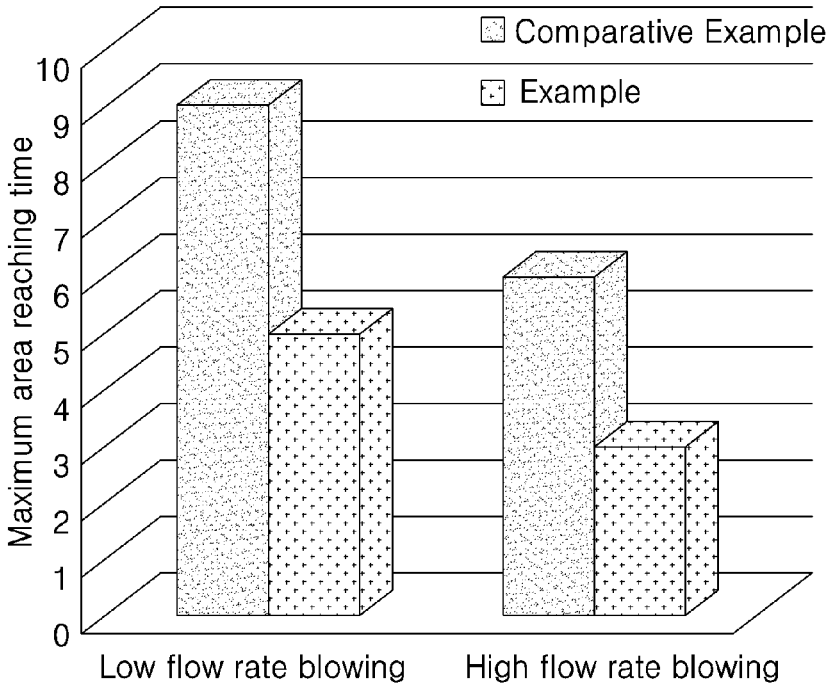
FIG. 3 is a graph showing a comparison between times to reach a maximum area in stirrings using an impeller in accordance with in accordance with Example and an impeller in accordance with Comparison Example.

FIG. 3 is a graph showing a comparison between times to reach a maximum area in stirring by using an impeller in accordance with in accordance with Example and an impeller in accordance with Comparison Example. Through an experiment, the same amount of water was poured into two containers having the same volume, and then an impeller in accordance with an exemplary embodiment was submerged in one container, and an impeller in accordance with Comparative Example was submerged in the other container. Also, while the respective impellers operated, the same amount of thymol was added. After that, measured was the time that thymol was diffused into water to maximum in each of containers in which the impeller in accordance with Example and the impeller in accordance with Comparative Example were respectively submerged. Also, experiments were performed under a low flow intake condition in which a gas is blown at a relatively small amount through a blowing nozzle, and a high flow intake condition in which the gas is blown at a relatively large amount as other variables. Here, the diffusion of thymol into water to maximum means that thymol spreads throughout water.

Figure 4:
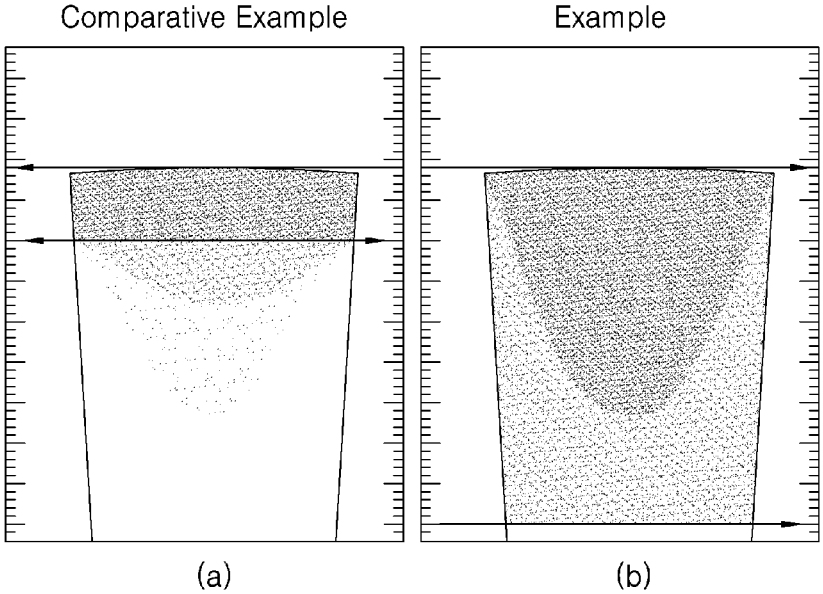
FIG. 4 shows views showing the mixing rate of paraffin oil in stirring using an impeller in accordance with Example and an impeller in accordance with Comparison Example for the same time (approximately 20 minutes).

FIG. 4 shows views illustrating mixing rates of paraffin oil through analyses of video data in stirring for the same time (approximately 20 minutes) by using an impeller in accordance with Example and an impeller in accordance with Comparison Example. Here, FIG. 4A is a view illustrating a mixing rate of paraffin oil in stirring by using an impeller in accordance with Comparison Example, and FIG. 4B is a view illustrating a mixing rate of paraffin oil in stirring by using an impeller in accordance with Example. For an experiment, the same amount of water is charged into two containers having the same volume, and then an impeller in accordance with an exemplary embodiment is submerged in one container, and an impeller in accordance with Comparative Example is submerged in the other container. Also, while the respective impellers operate, the same amount of thymol was added. Also, after the impeller in accordance with Example and the impeller in accordance with Comparative Example were rotated for 2 hours, a mixing depth of paraffin oil was measured.

Here, as shown in FIG. 1, the impeller 200 in accordance with an exemplary embodiment used in the experiment is an impeller 200 in which an blowing nozzle 230 is provided in a position corresponding to a lower region of melt-pool, and blades 220 are installed in a lower region of the melt-pool. Also, the impeller 20 in accordance with Comparative Example is a typical impeller 20 shown in FIG. 2, and has a structure in which the blowing nozzle 23 is provided to the blade 22.

Referring to FIG. 3, regardless of a low flow intake and a high flow intake, when the impeller 200 in accordance with an exemplary embodiment is used, the maximum area reaching time of thymol is shorter than that when the impeller 20 of Comparative Example is used.

Also, referring to FIGS. 4A and 4B, when stirring was performed by using the impeller 200 in accordance with Example, paraffin oil was mixed into entire water to show a red color, but when stirring was performed by using the impeller 20 in accordance with Comparative Example, paraffin oil was mixed into only an upper region of water and was not mixed into most regions of water. In more detail, when a length from a surface of water to a bottom of a container is defined as approximately 100%, paraffin oil was mixed to a point of approximately 93.5% from the surface of water in the case that stirring was performed by using the impeller 200 in accordance with Example, but paraffin oil was mixed to a point of approximately 19.6% from the surface of water in the case that stirring was performed by using the typical impeller 20.

From the experimental results described with reference to FIGS. 3 and 4, it could be seen that the stirring efficiency of the impeller 200 in accordance with Example was more excellent than that of the impeller 20 in accordance with Comparative Example. This is because as described above, in the impeller 200 in accordance with Example, the blade 200 and the blowing nozzle 230 are separated from each other, and the blades 220 is relatively positioned at an upper portion, and the blowing nozzle 230 is relatively positioned at a lower portion, and thus a flow generated by the rotation of the blades 220 and a flow of the additive sprayed from the blowing nozzle 230 flow in a mutual corresponding direction to be combined to each other, resulting in improvement of the overall stirring performance. In contrast, the impeller 20 in accordance with Comparative Example has a structure in which the blowing nozzle 23 is provided to the blade 22, a flow by the blade 22 and a flow of the additive sprayed from the blowing nozzle 23 collide with each other, resulting in a decrease in overall stirring performance.

For the convenience of the experiment in the above, thymol or paraffin oil was added to a general container, and a diffusion degree of the thymol or paraffin oil was measured. However, from the results shown in FIGS. 3 and 4, it may be expected that the stirring efficiency in which the impeller 200 in accordance with Example is submerged in the ladle 100 containing the melt-pool is more excellent than the stirring efficiency by the typical impeller 20.

The dephosphorization agent used for dephosphorizing the melt-pool in accordance with exemplary embodiments, i.e., a dephosphorization flux is a $BaCO_3$—BaO binary system. In addition, at the time that the dephosphorization agent (hereinafter, referred to as a dephosphorization flux) is added into the melt-pool, a dephosphorization flux in accordance with an exemplary embodiment is a flux in which solid BaO and liquid BaO coexists with each other, and a dephosphorization agent in accordance with another exemplary embodiment is a liquid $BaCO_3$—BaO binary flux.

First, the dephosphorization flux in accordance with an exemplary embodiment in which solid BaO and liquid BaO coexists with each other at the time that the dephosphorization flux is added into the melt-pool will be described.

Figure 5:
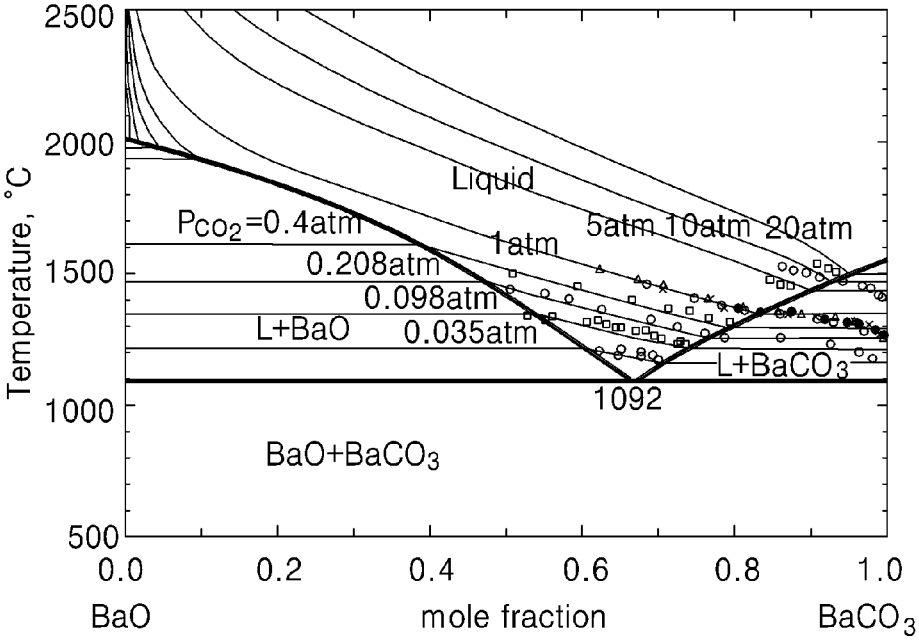
FIG. 5 is a phase diagram of the $BaCO_3$—BaO binary system in accordance with temperature and a mole fraction.

FIG. 5 is a phase diagram of a BaCO3-BaO binary system according to temperature and mole fraction.

In the present invention, under a condition that the dephosphorization flux is liquefied to be used, the dephosphorization performance of the dephosphorization flux to ferro manganese melt-pool may be maximized in the initial stage. When BaO is controlled to be positioned in a two-phase coexistence region of solid BaO and liquid BaO among various stable phase regions (a liquid phase region, a two-phase coexistence region of solid BaO and liquid BaO, and a two-phase coexistence region of solid $BaCO_3$ and liquid $BaCO_3$) shown in the phase diagram of the $BaCO_3$—BaO binary system at a temperature of approximately 1260° C. to approximately 1600° C. that is a dephosphorization process temperature of the ferro manganese melt-pool, the amount of BaO in the flux may be maximized to maintain high alkalinity from the initial state, and the partial pressure of $CO_2$ may be controlled at a low level in the two-phase coexistence region of BaO among the stable phases existing at the same temperature. Therefore, since the alkalinity of dephosphorization slag may be maintained at a low level according to the addition of the flux, the dephosphorization performance may be maximized. In addition, under a condition that as a distribution ratio of Mn and an Mn oxide is increased according to a temperature drop and dephosphorization continues, a phosphorus (P) content is decreased to decrease activity of the phosphorus and the partial pressure of $CO_2$ may be maintained at a low level in a condition of easy oxidation of Mn, so that the oxidizing of Mn may be suppressed.

Therefore, a reduction of alkalinity of the dephosphorization according the mixing of a Mn oxide may be minimized even at a relatively low temperature, and although a dephosphorization refining process is performed, the dephosphorization performance of the dephosphorization slag may be maintained at a high level.

Accordingly, in an exemplary embodiment of the present invention, a dephosphorization flux having a region in which BaO exists in two phases of solid and liquid is produced by calcinating $BaCO_3$. At this time, when the calcination reaction is performed and thus the composition moves toward a side in which the mole fraction of BaO is high, since the content of solid BaO is increased to lower the efficiency of the calcination reaction, and accordingly, in order to control BaO toward a two-phase region of a targeted composition, it is desirable that the calcination reaction is performed in a liquid region at a targeted composition.

Therefore, the calcination reaction of BaCO3 which is basically used as a ferro manganese dephosphorization flux is promoted to control the composition of BaCO3 and to use BaCO3 in a two-phase coexistence region, so that a dephosphorization flux having maximized dephosphorization performance is obtained to improve the dephosphorization efficiency.

The present invention is characterized in that a BaCO3-BaO binary system phase having a two-phase coexistence region of BaO with respect to the phase of a $BaCO_3$—BaO binary system is used as a dephosphorization flux by performing the calcination reaction of $BaCO_3$ in $BaCO_3$ or $BaCO_3$/NaF.

That is, as shown in the phase diagram of FIG. 5, BaO is created to be used as a dephosphorization flux by calcinating $BaCO_3$ such that BaO is positioned in a two-phase coexistence region of solid and liquid based on the liquidus line of BaO which is a boundary line between a liquid-solid phase and a liquid two-phase coexistence region.

The dephosphorization flux is characterized in that a minimum composition thereof, which is required according to the temperature of the ferro manganese melt-pool to be dephosphorized, is varied. For example, when the composition of a flux directly before the addition of the melt-pool is in the two-phase coexistence region of BaO based on the liquidus line at approximately 1100° C., the molar ratio of BaO and BaCO3 is approximately 65/35 and the flux contains BaO included in the two-phase coexistence region at approximately 1,100° C. However, when the flux is added to the melt-pool and thus the temperature of the ferro manganese melt-pool is 1350° C., the flux transforms into a liquid phase at the time of contacting the melt-pool. Therefore, although a flux in which BaO is positioned in a two-phase coexistence region to perform a calcination reaction at a temperature lower than that of the ferro manganese melt-pool, when the flux does not transforms into a phase necessary in a temperature of the ferro manganese melt-pool but transforms into a single phase of liquid, the introduction of the flux causes the same result as direct addition of an existing $BaCO_3$-based flux. Therefore, in the present invention, when the composition of the flux added is a composition in which BaO is included in a two-phase coexistence region of solid and liquid on the basis of the temperature (approximately 1,260° C. to approximately 1600° C.) of the ferro manganese melt-pool, a dephosphorization effect may be maximized. Accordingly, when the temperature of a calcination reaction is higher than that of the ferro manganese melt-pool, and the flux in which BaO is included in a two-phase coexistence region of solid and liquid is added to the melt-pool in any composition, BaO exists in two phases of solid and liquid from an initial stage. In contrast, in the case of the flux produced at the calcination reaction temperature lower than the temperature of the ferro manganese melt-pool, as described above, it is better to perform the calcination reaction enough to allow BaO to be included in a two-phase coexistence region on the basis of the temperature of the ferro manganese melt-pool.

In an embodiment of the present invention, the ferro manganese dephosphorization flux is a binary system in which $BaCO_3$ and BaO coexist by calcinating $BaCO_3$, includes a large amount of BaO compared to a typically available flux, and is produced in such a way that BaO exists in two phases of solid and liquid. In this regard, the state of BaO in the flux may be controlled by further adding carbon (C) and a flux ($NaF_2$) to $BaCO_3$ and adjusting the heating temperature.

Accordingly, in the present invention, fluxes were produced by using process conditions shown in Table 1 below.

TABLE 1

| Composition | Heating Atmosphere | $NaF_2$ Content | Content of carbon (C) | Heating Temperature | Heating Time (hour) |
|---|---|---|---|---|---|
| $BaCO_3$ + C | Ar | — | >(Number of moles of BaO based on liquidus line) × 0.6 | >1200° C. | >2 |
| | Air | — | >(Number of moles of BaO based on liquidus line) × 0.9 | >1200° C. | >2 |
| $BaCO_3$ + $NaF_2$ + C | Ar | >3.1 wt % | >(Number of moles of BaO based on liquidus line) × 0.6 | >1050° C. | >1.5 |
| | Air | >3.1 wt % | >(Number of moles of BaO based on liquidus line) × 0.9 | >1050° C. | >1.5 |
| $BaCO_3$ | Ar | — | — | >1330° C. | >2.5 |
| | Air | — | — | >1330° C. | >3 |

From review of Table 1, the heating temperature and heating time vary with existence or nonexistence of a substance ($NaF_2$, Carbon) mixed to the main raw material, $BaCO_3$, and the content of carbon (C) varies with the heating atmosphere. Herein, the content of carbon is obtained by calculating the number of moles of BaO generated based on the two-phase coexistence region of BaO and the boundary line of a liquid phase, i.e., a liquidus line, and then adding the number of moles of carbon to the number of moles of BaO, and carbon having the number of moles which is 0.9 times or more the number of moles of BaO in the air and carbon having the number of moles which is 0.6 times or more the number of moles of BaO in an inert gas atmosphere are mixed to promote a calcination reaction. Since carbon reacts with oxygen in the atmosphere in the atmospheric ambient to decrease the reaction efficiency, the atmospheric ambient requires a larger amount of carbon than the inert gas ambient.

$NaF_2$ is added to lower the melting point of the flux. When the proportion of $NaF_2$ increases, the process temperature may be further lowered. However, it may be necessary to lower the proportion of $NaF_2$ in order to minimize influence on the dephosphorization performance and environmental issues. Accordingly, $NaF_2$ may be added in a proper proportion within the range of 3.1 wt % to 10 wt %.

Thus, in a process of producing the flux, the heating time may be shortened in a stationary bath in accordance with stirring condition using gas mixing and shortened up to about 30 minutes.

In the above process, when C, $NaF_2$ or a mixture of C and $NaF_2$ is added and heated at a constant temperature or at a temperature above the temperatures listed in Table 1, a reaction represented by Reaction Formula 1 takes places.

$$BaCO_3+C \rightarrow BaO+2CO \quad \text{[Reaction formula 1]}$$

The CO gas generated in the reaction further lowers the partial pressure of $CO_2$ in equilibrium with $BaCO_3$ to thus promote the calcination reaction. The calcination reaction is ended in the above-described condition, i.e., when BaO is included in the binary phase coexistence region, and the measurement of progress degree of the calcination reaction may be conducted by sensing change in weight or sensing the vaporized amount of $CO_2$ or CO gas. In order to optimally complete the calcination reaction, it is important to control the composition of $BaCO_3$—BaO such that BaO exists in the two phase coexistence region at the temperature of the molten ferro manganese.

Meanwhile, when the calcination reaction progresses not to a two phase coexistence region but to a single phase region of liquid or a region where $BaCO_3$ is present in a two-phase region of solid and liquid at the time that BaO contacts the ferro manganese melt-pool in the ferro manganese melt-pool containing a predetermined amount of BaO, the effect that only $BaCO_3$ is added is generated and thus the dephosphorization effect is halved. However, in the case a predetermined amount of BaO is contained at an initial stage, this case exhibits a better dephosphorization effect than the case that only $BaCO_3$ is added, but since the partial pressure of $CO_2$ is high, the dephosphorization effect of this case is halved compared with the case that C or $NaF_2$ is added to the region where BaO coexists in two phases in aspects of prevention of oxidation of Mn and maintenance of high alkalinity.

Therefore, it is better that in the $BaCO_3$—BaO binary flux, the molar ratio of $BaCO_3$ and BaO is in a range of 0/100 to 67/33 corresponding to the region where BaO is included in the two phase coexistence region of solid and liquid.

Figure 6:
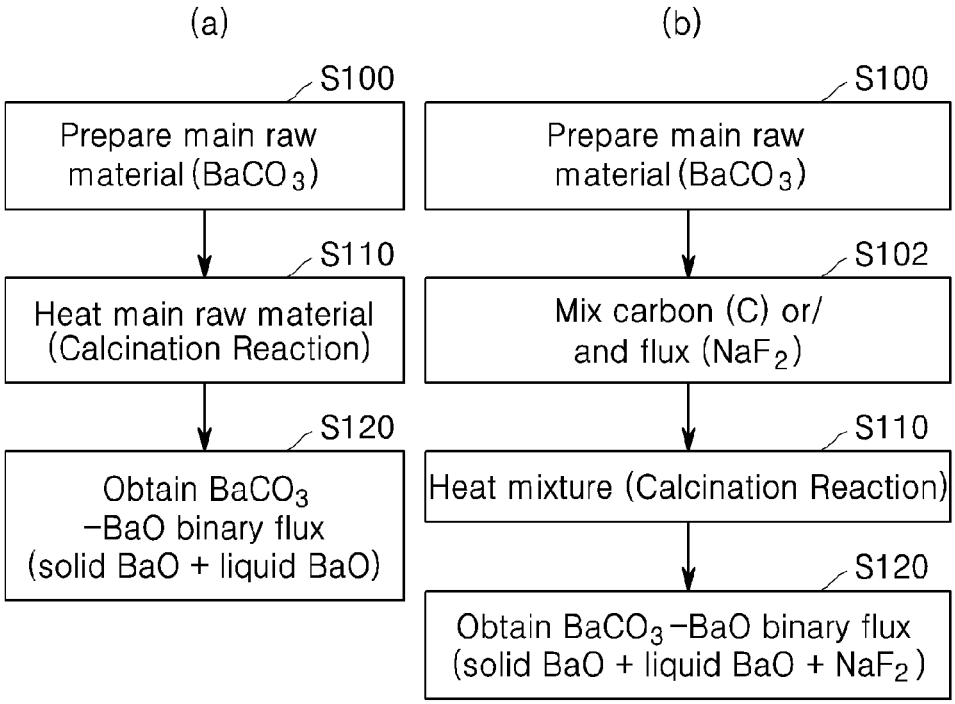
FIG. 6 is a flow chart showing a process of producing flux in accordance with an exemplary embodiment.

FIG. 6 is a flow chart showing a process of producing flux in accordance with an exemplary embodiment.

First, a main raw material, $BaCO_3$ is prepared (S100). $BaCO_3$ may be prepared in the form of powder.

Thereafter, as shown in FIG. 6B, carbon (C) or a dephosphorization agent ($NaF_2$) may be added or carbon and $NaF_2$ may be added and mixed (S102). In this regard, carbon (C) may be provided in the form of cokes or graphite, be provided in the form of powder, mixed with the main raw material, and stirred for uniform mixing therebetween. Carbon (C) promotes the calcination reaction of $BaCO_3$ to help $BaCO_3$ be transformed into a binary system of $BaCO_3$—BaO and when the dephosphorization agent, $NaF_2$ is added, carbon (C) contributes to lowering of the melting point of a flux to be produced.

Next, $BaCO_3$ or a mixture in which C and/or dephosphorization agent ($NaF_2$) is added in $BaCO_3$ is heated to cause a calcination reaction (S110). In this regard, the heating temperature is air or an inert gas (Ar or the like) atmosphere, and the heating may be conducted for at least 1.5 hours or more, and preferably for 1.5 hours to 5 hours. The heating temperature is set to 1,330° C. or higher in the case of only $BaCO_3$, to 1,200° C. or higher in the case only carbon (C) is added, and to 1,050° C. or higher in the case a dephosphorization agent ($NaF_2$) is added together with carbon (C).

By heating the mixture, a $BaCO_3$—BaO binary flux in which BaO exists in two phases of solid and liquid may be obtained (S120).

The flux produced thus may be used in the dephosphorization of ferro manganese melt-pool without an additional process.

Alternatively, the flux may be produced in solid phase to be used by lowering the temperature thereof to room temperature, for use later. In this case, since too large particle size of the flux reduces the reaction efficiency is reduced, the flux may be pulverized for use in a size of larger than 0 and smaller than 1 or equal to 1. Also, when the flux is in solid phase, there is a problem that since BaO has a high affinity to moisture, BaO is hydrated, the hydrated BaO reacts with $CO_2$ in the air to generate $BaCO_3$, and thus the effect of low melting point is reduced in storage of 1 or more days. So, it is better to use the flux in the solid phase as soon as possible. Alternatively, if the flux is stored in the form of lump and is pulverized to be used, it is possible to store the flux up to 1 week.

Flux was produced, changing temperature, heating atmosphere and content of additives, and hereinafter, component analysis results of the produced fluxes will be described.

TABLE 2

| | Temp. (° C.) | Hr | Air | Amounts of components added in flux (g) $BaCO_3$ | $NaF_2$ | C | Comp, of $NaF_2$ (wt %, C exclusive) | Content of C Based on liquidus line of BaO |
|---|---|---|---|---|---|---|---|---|
| Example 1 | 1350 | 2.5 | Ar | 95 | 5 | 1.5 | 5 | 1.1 times |
| Example 2 | 1150 | 5 | Air | 95 | 5 | 1.5 | 5 | 1.6 times |
| Example 3 | 1450 | 5 | Air | 100 | — | — | — | — |
| Comparative Example 1 | 1350 | 1 | Ar | 95 | 5 | 0.5 | 5 | 0.4 times |
| Comparative Example 2 | 1150 | 1 | Air | 95 | 5 | — | 5 | — |
| Comparative Example 3 | RT | 0 | Air | 95 | 5 | — | 5 | — |

Table 2 shows production conditions of fluxes. In this regard, the composition of $NaF_2$ indicates the proportion of $NaF_2$ to the total weight of $BaCO_3$ (carbon (C) exclusive) and the content of C indicates the weight of C per 1 g of $BaCO_3$.

Example 1

In Example 1, 95 g of $BaCO_3$, 5 g of $NaF_2$, and 1.5 g of carbon (C) were mixed, and this mixture was heated in an inert gas (Ar) atmosphere at 1,350° C. for 2.5 hours. In this regard, 1.5 g of the mixed carbon corresponds to 1.1 times the number of moles of BaO when BaO is produced in the composition based on the liquidus line that is a boundary line of a two-phase coexistence region of solid phase and liquid phase.

Example 2

In Example 2, 95 g of $BaCO_3$, 5 g of $NaF_2$, and 1.5 g of carbon (C) were mixed, and this mixture was heated in the air at 1,150° C. for 5 hours. In this regard, the content of carbon (C) corresponds to 1.6 times the liquidus line of BaO.

Example 3

In Example 3, 100 g of $BaCO_3$ was heated in the air at 1,450° C. for 5 hours.

Comparative Example 1

In Comparative Example 1, 95 g of $BaCO_3$, 5 g of $NaF_2$, and 0.5 g of carbon (C) were mixed, and this mixture was heated in an inert gas (Ar) atmosphere at 1,350° C. for 1 hours. In this regard, the content of carbon (C) corresponds to 0.4 times the liquidus line of BaO.

Comparative Example 2

In Comparative Example 2, 95 g of $BaCO_3$, 5 g of $NaF_2$ were mixed, and this mixture was heated in the air at 1,150° C. for 1 hour.

Comparative Example 3

In Comparative Example 3, 95 g of $BaCO_3$ and 5 g of $NaF_2$ were mixed to produce a flux.

The following table 3 shows component analysis results of the fluxes produced by the foregoing methods.

TABLE 3

| | Analysis value (wt %) | | | $X_{BaCO3}$ + $X_{BaO}$ = 1 | |
|---|---|---|---|---|---|
| | $BaCO_3$ | BaO | $NaF_2$ | $X_{BaCO3}$ | $X_{BaO}$ |
| Example 1 | 36.8 | 58.8 | 4.4 | 32.7 | 67.3 |
| Example 2 | 69.3 | 25.9 | 4.8 | 67.5 | 32.4 |
| Example 3 | 41.8 | 58.2 | — | 35.8 | 64.2 |
| Comparative Example 1 | 66.8 | 28.6 | 4.6 | 64.5 | 35.5 |
| Comparative Example 2 | 73.8 | 21.4 | 4.78 | 72.8 | 27.2 |
| Comparative Example 3 | 95 | — | | 100 | — |

Figure 7:
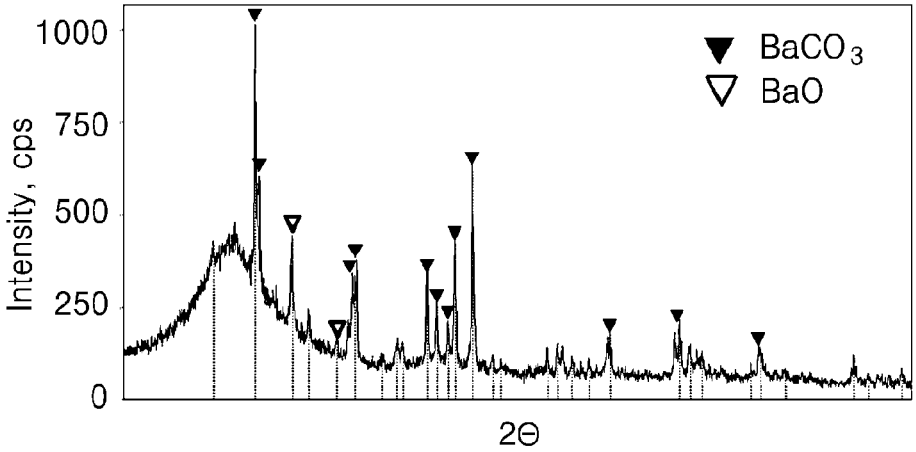
FIG. 7 is a graph showing X-ray diffraction extensible resource descriptor (XRD) analysis results of flux produced in accordance with Example 1.

Referring to Table 3, Ba, Na, and C were analyzed from the flux produced in Example 1 to calculate the contents of $BaCO_3$, BaO, and NaF, and it was confirmed that the content of $BaCO_3$ was 36.8 wt %, the content of BaO was 58.8 wt %, and the content of $NaF_2$ was 4.4 wt %. FIG. 7 is a graph showing X-ray diffraction extensible resource descriptor (XRD) analysis results of the flux produced in accordance with Example 1, and it was confirmed from the graph of FIG. 7 that $BaCO_3$ and BaO existed and non-reacted carbon (C) did not exist. It could be confirmed from the phase diagram of FIG. 5 that the molar ratio of $BaCO_3$ to BaO was 32.7/67.3 and was included within the two-phase coexistence region of liquid at 1,350° C. As seen from the phase diagram of FIG. 5, it could be confirmed that $BaCO_3$ detected in the XRD analysis was $BaCO_3$ produced on cooling.

It was confirmed from the analysis that in the flux produced in accordance with Example 2, the molar ratio of $BaCO_3$ to BaO was 67.5/32.4 and BaO may be included within the two-phase coexistence region of solid and liquid at 1,150° C.

The flux produced in accordance with Example 3 was made by making a calcination reaction of only $BaCO_3$ without mixing carbon (C) and $NaF_2$ in the air at 1,450° C. for 5 hours. It was confirmed from the analysis of this flux that the molar ratio of $BaCO_3$ to BaO is 35.8/64.2 and was included in the region where BaO exists in two phases of solid and liquid at 1,450° C. of the phase diagram of FIG. 5 as in Example 1 and 2.

Meanwhile, it was confirmed that in the flux of Comparative Example 1, the molar ratio of $BaCO_3$ to BaO was included within the region where BaO exists in two phases of solid and liquid. However, the flux of Comparative Example 1 was produced by adding carbon (C) as shown in Table 2, the content of the added carbon is less than the lower limit of the range proposed above, and the heating time is 1 hour and is not included within the proposed range. As a result, it was confirmed that the flux produced in accordance with Comparative Example 1 is included in the region where only liquid phase exists at 1,350° C. This result was considered as a phenomenon caused by the lack of the content of carbon and heating time, i.e., calcination reaction time. That is, according to the conditions proposed in Table 1, it could be seen that 1.5 hours or more of heating time was required when the flux, $NaF_2$ was added, and accordingly, it was understood that the main factors causing the phenomenon were the lacks of the content of carbon and reaction time.

Meanwhile, differences in dephosphorization behavior of the fluxes produced in accordance with Examples 1 and 2 and Comparative Example 3 were confirmed by performing dephosphorization tests in which a reaction between the fluxes produced in accordance with Examples 1 and 2 and Comparative Example 3 and ferro manganese melt-pool was made.

The dephosphorization tests were performed by adding the fluxes produced in accordance with Examples 1 and 2 and Comparative Example 3 in ferro manganese melt-pool, respectively, in which the proportion of the respective fluxes to the ferro manganese melt-pool was 30 g/20, an MgO crucible was used, and the dephosphorization atmosphere was controlled using Ar gas. Also, the test temperature and time were respectively 1,350° C. and 1 hour, and the produced specimens were rapidly cooled and then analyzed.

The following Table 4 shows dephosphorization test results of the fluxes produced in accordance with Examples 1 and 2 and Comparative Example 3.

TABLE 4

| | | Initial stage | Example 1 | Example 2 | Comparative Example 3 |
|---|---|---|---|---|---|
| Comp. of ferro Mn (wt %) | Mn | 72.53 | 70.47 | 68.56 | 67.92 |
| | Fe | 20.24 | 19.45 | 21.41 | 21.92 |
| | P | 0.051 | 0.011 | 0.018 | 0.020 |
| | Ba | 0.072 | 0.269 | 0.030 | 0.006 |
| | Si | 0.011 | 0.0028 | 0.006 | 0.002 |
| | C | 6.71 | 7.07 | 6.34 | 6.32 |
| Comp. of slag (wt %) | Mn | | 14.072 | 18.070 | 25.781 |
| | Fe | | 0.205 | 0.186 | 0.248 |
| | P | | 0.085 | 0.090 | 0.130 |
| | Ba | | 65.544 | 62.790 | 57.353 |
| | Si | | 0.031 | 0.068 | 0.105 |
| | Na | | 0.040 | 0.014 | 0.050 |

It was confirmed from the dephosphorization test that the flux of Example 1 in which BaO is included in the two-phase coexistence region of solid phase and liquid phase at 1,350° C. had the lowest phosphorous (P) content in ferro manganese after dephosphorization. In this regard, the dephosphorization rate was about 78.4%. It was also confirmed that after the reaction, the content of Mn of ferro manganese was highest, the content of Mn contained in slag after dephosphorization was lowest, and the content of Ba was relatively high.

It was seen that the flux of Example 2 in which BaO was included in the two-phase coexistence region of solid phase and liquid phase at 1,150° C. was transformed into the single phase region of liquid at 1,350° C. at which the dephosphorization tests were performed. Therefore, it could be understood that the flux of Example 2 was somewhat higher in the content of phosphorous than the flux of Example 1 and the content of Mn in ferro manganese was decreased. It was also seen that the content of Mn in slag was higher than the case that the flux of Example 1 was used and the content of Ba was low. These results were considered due to the fact that when BaO existed in only liquid phase at 1,350° C., the partial pressure of $CO_2$ was higher than that in the two-phase coexistence region as shown in FIG. 1 and thus had an influence on the oxidation of Mn as well as the oxidation of phosphorus (P).

Meanwhile, the flux of Comparative Example 3 was produced by simply mixing $BaCO_3$ and $NaF_2$, and the dephosphorization reaction starts from $BaCO_3$ (solid) as shown in FIG. 5. Accordingly, in the state that a large amount of $CO_2$ is supplied and the partial pressure of $CO_2$ is high as in Example 2, since the influence of the large amount of $CO_2$ in Comparative Example 3 is higher than that in Example 2, the oxidation of Mn as well as the oxidation of P is promoted. Accordingly, it could be seen that the content of Mn in the ferro manganese after dephosphorization was lowest. It can be also confirmed that the content of Mn in the slag is highest and the content of Ba is low. Therefore, it can be confirmed that $CO_2$ gas supplied by the calcination reaction of $BaCO_3$ is not only an important factor for oxidation of P but a factor greatly influencing the oxidation of Mn. An increase in oxidation of Mn lowers alkalinity of the dephosphorization slag to thus influence the dephosphorization efficiency, and as shown in FIG. 4, the content of phosphorous (P) is increased in the melt-pool after dephosphorization as in the case where the flux of Comparative Example 3 is used. That is, Comparative Example 3 has the largest amount of $CO_2$ that is the main supply source of oxygen necessary for oxidation compared with Examples 1 and 2, but eventually, Example 1 having the smallest amount of $CO_2$ has the highest dephosphorization efficiency. Thus, the influence of alkalinity that is an important factor influencing the dephosphorization can be understood, and it can be confirmed that it is necessary to suppress oxidation of Mn and to maximize the content of Ba in order to maintain high alkalinity and thus it is advantageous to use the flux in which BaO exists in two phases of solid and liquid.

A dephosphorization flux in accordance with another exemplary embodiment is to control the content of phosphorous (P) contained in ferro manganese melt-pool, and a Ba-based compound having high alkalinity and not having high vapor pressure is used as the dephosphorization flux. Since the Ba-based compound has a very high melting point as described above, it is produced in the form of solid, so that the dephosphorization efficiency thereof may be reduced. Accordingly, the Ba-based dephosphorization flux in accordance with the present invention is produced in the form of liquid by lowering the melting point thereof, which results in an increase in fluidity, an easy supply of the flux, and an increase in dephosphorization efficiency.

Accordingly, in exemplary embodiments, the calcinations reaction is promoted by mixing $BaCO_3$ and carbon (C) as a dephosphorization agent and heating this mixture, thus producing a binary system of liquid $BaCO_3$ and liquid BaO. In this regard, the content of carbon (C) added in $BaCO_3$ and the heating temperature may be controlled to lower the melting point of the flux and producing the flux in liquid.

In order to promote the calcinations reaction, it is advantageous that $BaCO_3$ be produced in liquid phase in an initial stage, and if the $BaCO_3$ is not produced in liquid phase, the efficiency of calcination reaction is lowered and the process time is unnecessarily increased.

Therefore, predetermined amounts of C and flux ($NaF_2$) are mixed with a main raw material, $BaCO_3$ and the heating temperature and heating time for calcination reaction are properly controlled to enhance the efficiency of the calcination reaction and lower the melting point.

Accordingly, in the present invention, fluxes were produced using the process conditions listed in Table 5.

TABLE 5

| Composition | Heating atmosphere | Content of $NaF_2$ | Content of C (per 1 g of $BaCO_3$) | Heating temperature | Heating time |
|---|---|---|---|---|---|
| $BaCO_3$ + C | Ar | — | >0.019 g | >1320° C. | >1 hour |
| | Air | — | >0.031 g | >1320° C. | 1 hour |

TABLE 5-continued

| Composition | Heating atmosphere | Content of $NaF_2$ | Content of C (per 1 g of $BaCO_3$) | Heating temperature | Heating time |
|---|---|---|---|---|---|
| $BaCO_3$ + $NaF_2$ + C | Ar | >3.1 wt % | >0.018 g | >1050° C. | >1 hour |
| | Air | >3.1 wt % | >0.024 g | >1050° C. | >1 hour |

From review of Table 1, the heating temperature varies with existence or nonexistence of a substance ($NaF_2$, Carbon) mixed to the main raw material, $BaCO_3$, and the content of carbon (C) varies with the heating atmosphere. For example, in the case where heating (calcination reaction) is made in the air, a larger amount of carbon (C) than that for heating in an inert gas (Ar) atmosphere may be mixed because of a reaction with oxygen in the air. When the proportion of $NaF_2$ is increased, the eutectic point may be further lowered, but the proportion of $NaF_2$ is properly decreased to minimize the influence of dephosphorization performance and environmental issues. Accordingly, $NaF_2$ may be added in a proper proportion within the range of 3.1 wt % to 10 wt %.

Thus, in a process of producing the flux, the heating time may be shortened in a stationary bath in accordance with stirring condition using gas mixing and shortened up to about 30 minutes.

In the above process, when C or a mixture of C and $NaF_2$ is added and heated at a constant temperature or at a temperature above the temperatures listed in Table 5, a reaction represented by Reaction Formula 1 occurs.

The CO gas generated in the reaction further lowers the partial pressure of $CO_2$ in equilibrium with $BaCO_3$ to thus promote the calcination reaction.

Figure 8:
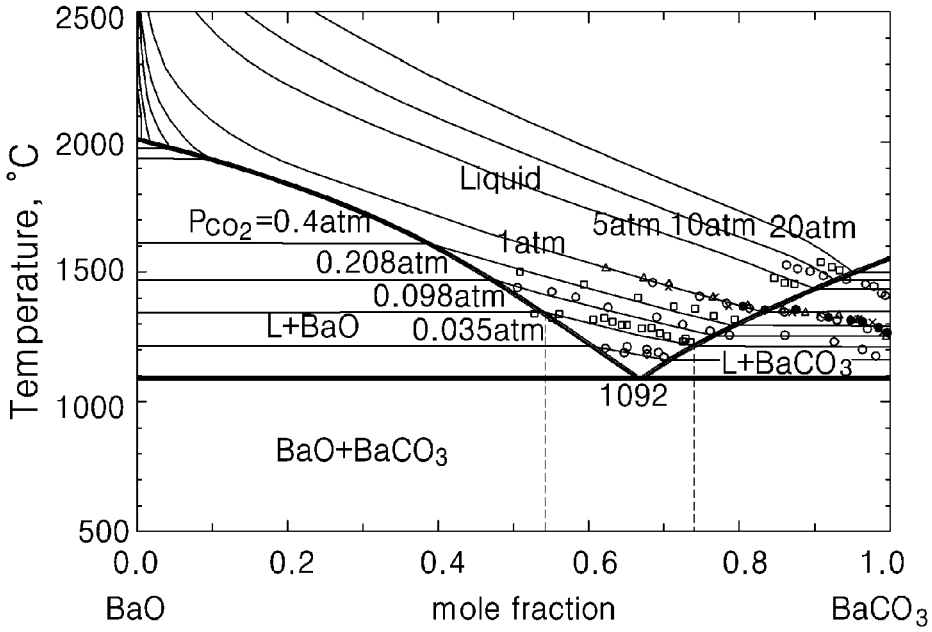
FIG. 8 is a phase diagram of a BaO—$BaCO_3$ binary system dephosphorization flux generated through a calcination reaction.

FIG. 8 is a phase diagram of a BaO—$BaCO_3$ binary system dephosphorization flux generated through a calcination reaction.

Referring to FIG. 8, a $BaCO_3$—BaO binary dephosphorization flux has the melting point of 1,092° C. when the molar ratio of $BaCO_3$ to BaO is 67/33. Thus, the $BaCO_3$—BaO binary dephosphorization flux may increase the dephosphorization efficiency when the eutectic point has the lowest composition. In this regard, the process control may be conducted by sensing a change in weight of the mixed raw materials, and although the final temperature for the dephosphorization refining of ferro manganese is lowered to approximately 1,300° C., a stably available molar ratio of $BaCO_3$ to BaO is in a range of 55/45 to 75/25. That is, when the molar ratio of $BaCO_3$ to BaO is included within the proposed range, the melting point of the flux is lowered and thus exists in liquid form, so that the dephosphorization efficiency may be increased.

Figure 9:
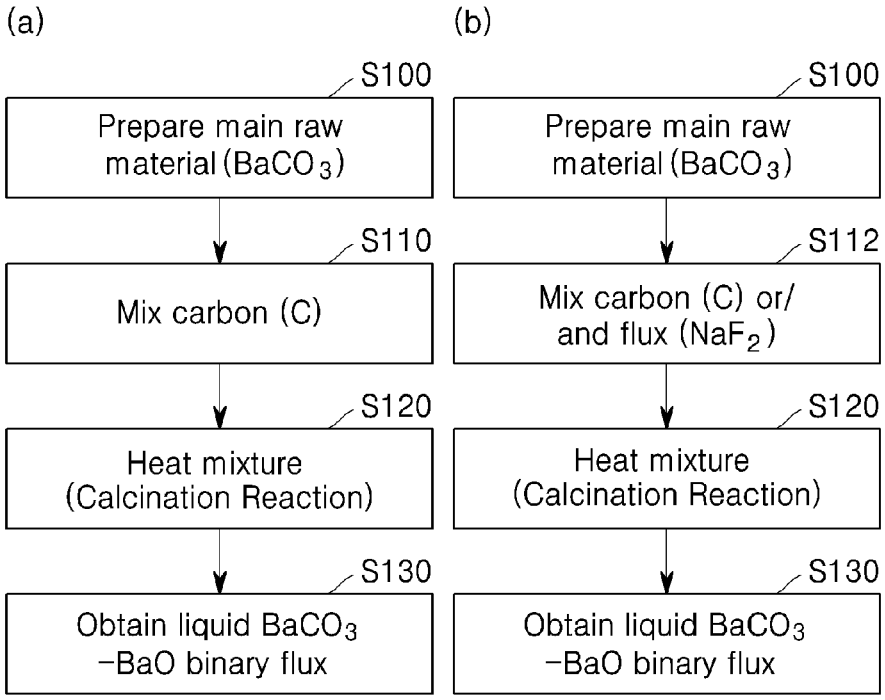
FIG. 9 is a flow chart showing a process of producing a dephosphorization flux in accordance with another exemplary embodiment.

FIG. 9 is a flow chart showing a process of producing a dephosphorization flux in accordance with another exemplary embodiment.

First, a main raw material, $BaCO_3$ is prepared (S100). $BaCO_3$ may be prepared in the form of powder.

Thereafter, carbon (C) is added to the main raw material and carbon (C) and the main raw material are mixed (S110). Carbon (C) may be provided in the form of cokes or graphite, be provided in the form of powder, mixed with the main raw material, and stirred for uniform mixing therebetween. Carbon (C) promotes the calcination reaction of $BaCO_3$ to thus help $BaCO_3$ be transformed into a $BaCO_3$—BaO binary system.

In this regard, as shown in FIG. 9B, a flux, $NaF_2$, may be added together with carbon (C) to the main raw material (S112). The addition of the flux, $NaF_2$ may help a produced flux lower the melting point thereof.

Next, a mixture of $BaCO_3$ and carbon (C) or a mixture in which C and a dephosphorization agent ($NaF_2$) are added in $BaCO_3$ is heated to calcinate $BaCO_3$ (S120). In this regard, the heating temperature is air or an inert gas (Ar or the like) atmosphere, and the heating may be conducted for at least 1 hour or more. The heating temperature is set to 1,320° C. or higher in the case only carbon (C) is added, and 1,050° C. or higher in the case a dephosphorization agent ($NaF_2$) is added together with carbon (C).

By heating the mixture, a liquid $BaCO_3$—BaO binary flux having the molar ratio range proposed above may be obtained (S130). The obtained flux may have a eutectic temperature in a range of approximately 200° C. to approximately 300° C., which is lower than that of typically available $BaCO_3$—BaO. That is, the eutectic point may be lowered according to the mixed amount of carbon (C) and the flux ($NaF_2$) added in producing the flux.

The liquid flux produced thus may be used directly. The liquid flux produced thus is added in ferro manganese melt-pool in a high temperature state and may maintain the liquid state at the time of end of dephosphorization.

Alternatively, the liquid flux may be solidified to be used by lowering the temperature thereof to room temperature. In this case, if particle size of the flux is too large, since the reaction efficiency is reduced, the flux may be pulverized to be used in a size of larger than 0 and smaller than 1 or equal to 1. Also, when the flux is in solid phase, there is a problem that since BaO has a high affinity to moisture, BaO is hydrated, the hydrated BaO reacts with $CO_2$ in the air to generate $BaCO_3$, and thus the effect of low melting point is reduced in storage of 1 or more days. So, it is better to use the flux in the solid phase as soon as possible. Accordingly, if the flux is stored in the form of lump and is pulverized to be used, it is possible to store the flux up to 1 week.

Fluxes were produced, changing temperature, heating atmosphere and content of additives, and hereinafter, component analysis results of the produced flux will be described.

TABLE 6

| | Temp. | | | Amounts of components mixed in flux (g) | | | Comp, of $NaF_2$ (wt %, C | Content |
|---|---|---|---|---|---|---|---|---|
| | (° C.) | Hr | Atm | $BaCO_3$ | $NaF_2$ | C | exclusive) | of C |
| Example 4 | 1100 | 2.5 | Ar | 61.5 | 3.91 | 1.5 | 3.91 | |
| Example 5 | 1100 | 1 | Ar | 47.5 | 5 | 2.9 | 5 | 0.061 |
| Example 6 | 1100 | 2.5 | Air | 47.5 | 5 | 1.9 | 5 | 0.04 |
| Example 7 | 1100 | 1 | Air | 95 | 5 | 5.6 | 5 | 0.059 |
| Example 8 | 1400 | 1 | Air | 47.5 | 0 | 2 | 0 | 0.061 |
| Comparative Example 4 | 1100 | 1 | Ar | 61.5 | 2.38 | 1 | 2.38 | 0.016 |
| Comparative Example 5 | 1100 | 2.5 | Air | 47.5 | 0 | 1 | 0 | 0.021 |

Table 6 shows production conditions of flux. In this regard, the composition of $NaF_2$ indicates the proportion of $NaF_2$ to the total weight of $BaCO_3$ (carbon (C) exclusive) and the content of C indicates the weight of C per 1 g of $BaCO_3$.

Example 4

In Example 4, 61.5 g of $BaCO_3$, 2.5 g of $NaF_2$, and 0.024 g of carbon (C) per 1 g of $BaCO_3$ were mixed, and this mixture was heated in an inert gas (Ar) atmosphere at 1,100° C. for 2.5 hours.

Example 5

In Example 5, 47.5 g of $BaCO_3$, 2.5 g of $NaF_2$, and 0.061 g of carbon (C) per 1 g of $BaCO_3$ were mixed, and this mixture was heated in an inert gas (Ar) atmosphere at 1,100° C. for 1 hours.

Example 6

In Example 6, 47.5 g of $BaCO_3$, 2.5 g of $NaF_2$, and 0.04 g of carbon (C) per 1 g of $BaCO_3$ were mixed, and this mixture was heated in the air at 1,100° C. for 2.5 hours.

Example 7

In Example 7, 95 g of $BaCO_3$, 5 g of $NaF_2$, and 0.059 g of carbon (C) per 1 g of $BaCO_3$ were mixed, and this mixture was heated in the air at 1,100° C. for 1 hours.

Example 8

In Example 8, 47.5 g of $BaCO_3$ and 0.061 g of carbon (C) per 1 g of $BaCO_3$ were mixed, and this mixture was heated in the air at 1,400° C. for 1 hours.

Comparative Example 4

In Comparative Example 4, 61.5 g of $BaCO_3$, 1.5 g of $NaF_2$, and 0.016 g of carbon (C) per 1 g of $BaCO_3$ were mixed, and this mixture was heated in an inert gas (Ar) atmosphere at 1,100° C. for 1 hours.

Comparative Example 5

In Comparative Example 5, 47.5 g of $BaCO_3$ and 0.016 g of carbon (C) per 1 g of $BaCO_3$ were mixed, and this mixture was heated in the air at 1,100° C. for 2.5 hours.

Comparative Example 3

In Comparative Example 6, 47.5 g of $BaCO_3$ was heated in an inert gas (Ar) atmosphere at 1,100° C. for 1 hour.

Comparative Example 7

In Comparative Example 7, 47.5 g of $BaCO_3$, 2.5 g of $NaF_2$ were mixed, and this mixture was heated in the air at 1,100° C. for 1 hour.

The following table 7 shows component analysis results of the fluxes produced by the foregoing methods.

TABLE 7

| | Liquefaction | Analysis value (wt %) | | | $X_{BaCO3} + X_{BaO} = 1$ | |
|---|---|---|---|---|---|---|
| | — | $BaCO_3$ | BaO | $NaF_2$ | $X_{BaCO3}$ | $X_{BaO}$ |
| Example 4 | ○ | 72.62 | 23.18 | 4.20 | 0.71 | 0.29 |
| Example 5 | ○ | 72.13 | 23.25 | 4.62 | 0.71 | 0.29 |

TABLE 7-continued

| | Liquefaction | Analysis value (wt %) | | | $X_{BaCO3} + X_{BaO} = 1$ | |
|---|---|---|---|---|---|---|
| | — | $BaCO_3$ | BaO | $NaF_2$ | $X_{BaCO3}$ | $X_{BaO}$ |
| Example 6 | ○ | 70.81 | 24.66 | 4.53 | 0.69 | 0.31 |
| Example 7 | ○ | 66.59 | 28.55 | 4.86 | 0.64 | 0.36 |

Referring to Table 7, it could be seen that in Example 4, $BaCO_3$ was calcinated by carbon (C) to generate a large amount of BaO, and BaCO3 was 72.62 wt % and BaO was 23.18 wt %. The molar ratio ($BaCO_3$/BaO) was 71/29 included in the liquid region. When the flux produced in accordance with Example 4 is produced in solid phase, the flux transforms into liquid phase, so that respective constituent components are uniformly distributed.

When the components of the flux produced in accordance with Example 5 were analyzed, similar results to those of Example 4 were obtained. The heating time for production of the flux in Example 5 was set to the time less than that of Example 4 by 1.5 hours, and it could be seen from such a setting that when the contents of $NaF_2$ and C were increased, the reaction rate was increased and the produced flux was included in the liquid region.

Figure 10:
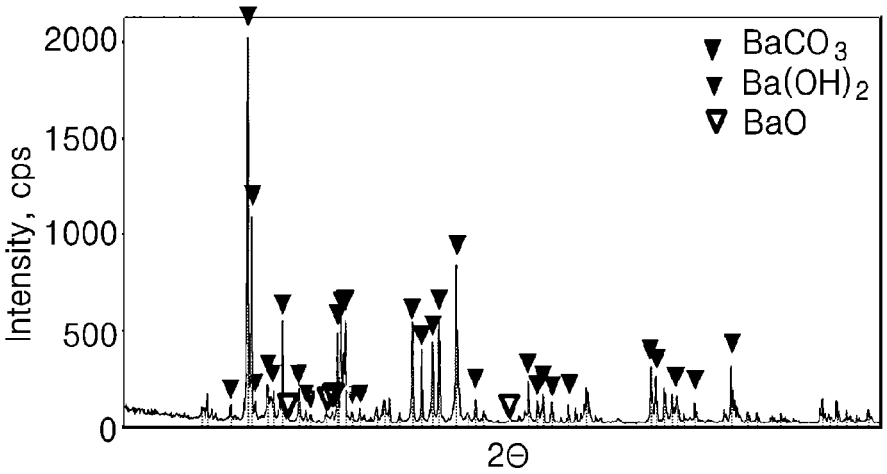
FIG. 10 is a graph showing XRD analysis results of the flux produced in accordance with Embodiment 6.

The calcination reaction in Example 6 was conducted longer than that in Example 5, and thus the molar ratio ($BaCO_3$/BaO) was 69/31. It could be seen from the obtained molar ratio that the flux of Example 6 was produced in liquid phase. FIG. 10 is a graph showing X-ray diffraction extensible resource descriptor (XRD) analysis results of flux produced in accordance with Embodiment 6. Referring to FIG. 10, it could be seen that BaO and $BaCO_3$ existed in the flux and $Ba(OH)_2$ also existed. $Ba(OH)_2$ was considered to be barium (Ba) hydrate which is produced due to strong affinity of BaO produced by the calcination reaction to moisture.

The molar ratio ($BaCO_3$/BaO) of the flux produced in accordance with Example 7 was 64/36, and it could be seen from this result that the calcination reaction in Example 7 was further performed to increase the content of BaO.

From the results of Examples 4-7, it could be confirmed that the increase in heating time or the increase in content of $NaF_2$ or C at the same temperature promoted the calcination reaction.

Meanwhile, the molar ratio ($BaCO_3$/BaO) of the flux produced in accordance with Example 8 was 63/37, and it could be seen from this molar ratio that the flux was liquefied too. From this result, it could be seen that when the flux, $NaF_2$ was not added, the heating temperature was increased, and in this case, when the content of carbon (C) was increased, the calcination reaction was promoted.

From the measurement results of components of the fluxes produced in accordance with Comparative Example 4-6, it could be seen that when the heating temperature and heating time were the same as those of Examples 4-7 and the content of carbon (C) was a specific value or less, the calcination reaction was insignificant and thus a small amount of BaO was produced or was not produced. Also, it could be seen that the produced flux was not liquefied. The flux produced in accordance with Comparative Example 4 has holes artificially formed for experiment, and the holes are maintained because the flux is formed in solid phase.

On the other hand, while the flux produced in accordance with Comparative Example 7 was liquefied, the molar ratio of $BaCO_3$ to BaO was not included within the foregoing range. Thus, the liquefaction of the flux produced in accordance with Comparative Example 7 is considered to be due to drop in melting point by addition of a large amount of flux, $NaF_2$.

From the analysis results, it could be seen that when predetermined amounts of carbon (C) and $NaF_2$ were added and this mixture was heated above a predetermined temperature, the calcination reaction was promoted to lower the melting point of the flux.

Meanwhile, a dephosphorization equilibrium experiment was conducted using the flux of Example 7 and the flux of Comparative Example 7 among the fluxes produced as above.

The equilibrium experiment was conducted in an Ar gas atmosphere, at 1,300° C. for 5 hours by using an MgO crucible. In this regard, the proportion of flux to metal was 30 g/20 g, in which the metal was ferro manganese (FeMn). The equilibrium experiment results are shown in Table 8 below.

TABLE 8

| | Mn (wt %) | Fe (wt %) | P (wt %) | Others (wt %) |
|---|---|---|---|---|
| Initial FeMn (20 g) | 70.08 | 18.09 | 0.133 | 11.697 |
| Example 7 | 67.38 | 25.37 | 0.034 | 7.216 |
| Comparative Example 7 | 65.44 | 27.39 | 0.041 | 7.129 |

Referring to Table 8, it could be seen that when the flux produced in accordance with Example 7 containing the greatest amount of BaO was used after the equilibrium experiment, the concentration (content) of phosphorous (P) was lowest and the proportion of Mn was also high in the ferro manganese. That is, it could be seen that the flux produced in accordance with Example 7 had very excellent fluidity due to the low melting point thereof and maintained alkalinity of slag at a high value from the initial stage of dephosphorization due to high initial content of BaO to thus enhance the dephosphorization efficiency.

Hereinafter, a dephosphorization process of melt-pool in which the impeller 200 in accordance with an exemplary embodiment is submerged in the ladle 100 containing the melt-pool will be described.

First, melt-pool for producing ferro manganese, i.e., molten ferro manganese is poured into the ladle 100, and the impeller 200 is submerged in the melt-pool. As described above, the impeller 200 in accordance with the exemplary embodiment includes the impeller body 210, the blowing nozzle 230 provided to a lower portion of the impeller body 210, the plurality of blades 220 disposed at an upper side and installed spaced apart from the blowing nozzle 230, and the supply pipe 240 configured to longitudinally pass through an inside of the impeller body 210 to supply a dephosphorization flux to the blowing nozzle 230.

The blades 220 of the impeller 200 in accordance with the exemplary embodiment is positioned at an upper region of the melt-pool such that upper surfaces thereof are adjacent to a bath surface of the melt-pool, and the blowing nozzle 230 is positioned in the lower region of the melt-pool to be adjacent to the bottom surface of the ladle 100, as shown in FIG. 1. For example, the blades 220 are positioned at a region within a ¼ position from the bath surface of the melt-pool contained in the ladle 110, and the blowing nozzle 230 is positioned at a region exceeding a ¾ position. In other words, the blades 220 are positioned in the upper region inside the melt-pool, and the blowing nozzle 230 is positioned in the lower region inside the molten pig iron.

When the impeller 200 is submerged in the melt-pool, the impeller 200 is rotated by the driving unit and a dephosphorization flux is supplied to the blowing nozzle 230 via the supply pipe 240. As the entire impeller 200 rotates, the blades 220 and the impeller body 210 rotate, so that materials contained in the ladle 100 are stirred. That is, the dephosphorization flux sprayed through the blowing nozzle 230 and the melt-pool are stirred and mixed. In more detail, as shown in FIG. 1, a stirring flow (an arrow of solid line) generated by rotation of the blades 220 is generated in the inner wall direction of the ladle 100 from the blades 220 and collides with the inner wall of the ladle 220, and then is divided and flows in up and down directions along the inner wall of the ladle 100. Also, the stirring flow of the dephosphorization agent sprayed from the blowing nozzle 230 ascends at right angles along the outer circumferential surface of the impeller body 210, then flows in the inner wall direction of the ladle 100 from the upper region of the molten pig iron to descend by rotation of the blades 220, and again ascends along the outer circumferential surface of the impeller body 210 (an arrow of dotted line). The stirring flow by the dephosphorization flux has a flow direction corresponding to the flow generated by rotation of the blades 220, and in more detail, the flow colliding with the inner wall of the ladle 110 and then moving in a downward direction. Accordingly, the stirring flow by the dephosphorization flux sprayed from the blowing nozzle 230 does not collide with the stirring flow by the blades 220 unlike the related art, and the two stirring flows move in the direction corresponding to each other and are combined to enhance the stirring force.

The melt-pool and the dephosphorization flux react with each other by the stirring, so that phosphorous (P) in the melt-pool moves to the slag and is removed from the melt-pool. In this regard, since the stirring force is increased compared with the related art by using the impeller 200 in accordance with the exemplary embodiment, the reaction rate between the melt-pool and the flux is increased and thus removal rate of phosphorous (P) in the melt-pool is increased. Therefore, ferro manganese melt-pool containing a less amount of phosphorous (P) than that of the related art can be easily produced and working time for removing phosphorous (P) can be decreased.

Also, the dephosphorization flux used in the dephosphorization process using the impeller 200 in accordance with the exemplary embodiment is a dephosphorization flux produced in accordance with any of Examples having the production flow of FIG. 6, and is a $BaCO_3$—BaO binary dephosphorization flux. In the binary $BaCO_3$—BaO flux, the mole fraction of $BaCO_3$ to BaO is in a range of 0/100 to 67/33 corresponding to the region where BaO is included in the two-phase coexistence region of solid and liquid. Accordingly, when the dephosphorization flux in accordance with any of Examples is added through the supply tube 240, solid BaO and liquid BaO coexists with each other at the time that the dephosphorization flux is added. Alternatively, $NaF_2$ may be further added to the dephosphorization flux, and is contained in an amount more than 3.1 wt % and equal to 10 wt % or less with respect to the total weight of the flux.

Thus, by using a $BaCO_3$—BaO binary dephosphorization flux in which solid BaO and liquid BaO coexists with each other in dephosphorization, the partial pressure of $CO_2$ can be lowered to maximize the dephosphorization performance. Also, since the content of BaO in the dephosphorization flux is high, high alkalinity can be maintained from the initial process of dephosphorization to thus suppress oxidation of Mn.

Also, the dephosphorization flux used in the dephosphorization process using the impeller 200 in accordance with the exemplary embodiment is a dephosphorization flux produced in accordance with any of Examples having the production flow of FIG. 9, and is a $BaCO_3$—BaO binary dephosphorization flux. In the $BaCO_3$—BaO binary flux, the molar ratio of $BaCO_3$ to BaO is 55/45 to 75/25. Alternatively, $NaF_2$ may be further added to the dephosphorization flux, and is contained in an amount more than 3.1 wt % with respect to the total weight of the flux. In the production of the dephosphorization agent, by mixing carbon (C) to the dephosphorization flux having $BaCO_3$ as a main component to cause a calcination reaction, the melting point of the dephosphorization flux can be decreased through the composition of the eutectic point of the $BaCO_3$—BaO binary system. Accordingly, the calcination reaction by addition of carbon (C) at a relatively low temperature can be promoted and the calcination reaction by addition of carbon (C) at a relatively high temperature can be promoted without addition of a separate flux. Further, a desired composition of melt-pool can be produced by enhancing the dephosphorization efficiency.

It has been described that an impeller in accordance with an exemplary embodiment, a dephosphorization flux in accordance with an exemplary embodiment, and a dephosphorization flux in accordance with another exemplary embodiment are used for dephosphorization of ferro manganese melt-pool. The inventive concept is not limited thereto, and the impeller and the dephosphorization agent in accordance with exemplary embodiments may be used for dephosphorization of molten pig iron from a blast furnace.

INDUSTRIAL APPLICABILITY

An impeller and a processing method using the same can easily remove a phosphorous (P) component contained in melt-pool. Therefore, dephosphorization process efficiency, especially, the efficiency of dephosphorization removing a phosphorous (P) component from ferro manganese melt-pool can be enhanced and the process time for dephosphorization can be decreased, resulting in an increase in production yield.

What is claimed is:

1. A method of processing melt-pool, the method comprising:

preparing a melt-pool;

preparing a dephosphorization flux controlling a phosphorous (P) component contained in the melt-pool;

submerging an impeller into the melt-pool;

supplying the dephosphorization flux into the impeller to blow the dephosphorization flux into the melt-pool;

rotating the impeller to stir the melt-pool into which the dephosphorization flux is blown, wherein the stirring comprises: stirring the melt-pool such that a first stirring flow direction of the melt-pool generated by a blade of the impeller corresponds to a second stirring flow direction of the melt-pool generated by the dephosphorization flux blown into the melt-pool, wherein the preparing of the dephosphorization flux comprises: preparing a main raw material including $BaCO_3$; and heating the main raw material to obtain a $BaCO_3$—BaO binary dephosphorization flux in which a solid BaO and a liquid BaO coexist with each other, and wherein a molar ratio of $BaCO_3$ to BaO exceeds 0/100 and is equal to or less than 67/33.

2. The method of claim 1, wherein the first stirring flow direction is divided into up and down flow directions, and an area of the down flow direction is wider than an area of the up flow direction.

3. The method of claim 2, wherein the down flow direction corresponds to the second stirring flow direction.

4. A method of processing melt-pool, the method comprising:

preparing a melt-pool;

preparing a dephosphorization flux controlling a phosphorous (P) component contained in the melt-pool;

submerging an impeller into the melt-pool;

supplying the dephosphorization flux into the impeller to blow the dephosphorization flux into the melt-pool;

rotating the impeller to stir the melt-pool into which the dephosphorization flux is blown, wherein the stirring comprises: stirring the melt-pool such that a first stirring flow direction of the melt-pool generated by a blade of the impeller corresponds to a second stirring flow direction of the melt-pool generated by the dephosphorization flux blown into the melt-pool, wherein the preparing of the dephosphorization flux comprises: preparing a main raw material including $BaCO_3$; mixing a carbon (C) component to the main raw material; and heating the main raw material mixed with the carbon (C) component to obtain a liquid $BaCO_3$—BaO binary dephosphorization flux, and wherein a molar ratio of $BaCO_3$ to BaO ($BaCO_3$/BaO) ranges from 55/45 to 75/25.

5. The method of claim 1, wherein the preparing of the dephosphorization flux further comprises: mixing at least one of carbon (C) and $NaF_2$ to the main raw material.

6. The method of claim 5, wherein the $NaF_2$ is mixed in a proportion more than 3.1 wt % and less than or equal to 10 wt % with respect to a total weight of the dephosphorization flux.

7. The method of claim 5, wherein the heating is conducted in the air or an inert gas atmosphere for 1.5 hours to 5 hours.

8. The method of claim 5, wherein the carbon (C) is mixed in an amount 0.6 times the number of moles of BaO.

9. The method of claim 7, wherein the heating is conducted at a temperature of 1,050° C. or higher.

10. The method of claim 4, wherein the preparing of the dephosphorization flux further comprises: mixing $NaF_2$ to the main raw material.

11. The method of claim 10, wherein the $NaF_2$ is mixed in a proportion more than 3.1 wt % with respect to a total weight of the dephosphorization flux.

12. The method of claim 4, wherein in the mixing the carbon (C) component, the carbon (C) component is mixed in an amount exceeding 0.018 g per 1 g of $BaCO_3$.

13. The method of claim 12, wherein the heating is conducted in the air or an inert gas atmosphere for 1 hours to 3 hours.

14. The method of claim 13, wherein the amount of the carbon (C) component added in the heating in the air is more than the amount of carbon (C) component added in the heating in the inert gas atmosphere.

15. The method of claim 12, wherein the heating is conducted at a temperature of 1,050° C. or higher.

16. The method of claim 4, wherein in the heating, the following reaction takes places:

$$BaCO_3+C \rightarrow BaO+2CO.$$

17. The method of claim 1, further comprising: after the obtaining of the dephosphorization flux, solidifying the dephosphorization flux; and pulverizing the solidified dephosphorization flux.

18. The method of claim 17, wherein the solidified dephosphorization flux is pulverized in a size exceeding 0 mm and less than or equal to 1 mm.

19. The method of claim 4, wherein the first stirring flow direction is divided in up and down flow directions, and an area of the down flow direction is wider than an area of the up flow direction.

20. The method of claim 19, wherein the down flow direction corresponds to the second stirring flow direction.

21. The method of claim 4, further comprising: after the obtaining of the dephosphorization flux, solidifying the dephosphorization flux; and pulverizing the solidified dephosphorization flux.

22. The method of claim 21, wherein the solidified dephosphorization flux is pulverized in a size exceeding 0 mm and less than or equal to 1 mm.

* * * * *